US006783207B1

(12) United States Patent
Seto et al.

(10) Patent No.: US 6,783,207 B1
(45) Date of Patent: Aug. 31, 2004

(54) INKJET RECORDING HEAD AND INKJET RECORDING DEVICE

(75) Inventors: Shinji Seto, Ebina (JP); Shigeru Umehara, Ebina (JP); Torahiko Kanda, Ebina (JP)

(73) Assignee: Fuji Xerox Co., Ltd., Minato-Ku (JP)

( * ) Notice: Subject to any disclaimer, the term of this patent is extended or adjusted under 35 U.S.C. 154(b) by 0 days.

(21) Appl. No.: 10/689,977

(22) Filed: Oct. 22, 2003

(30) Foreign Application Priority Data

Mar. 24, 2003 (JP) ..... 2003-80949

(51) Int. Cl.[7] ..... B41J 2/145; B41J 2/15
(52) U.S. Cl. ..... 347/40
(58) Field of Search ..... 347/40, 42, 47

(56) References Cited

U.S. PATENT DOCUMENTS 4,621,273 A * 11/1986 Anderson ..... 347/40
5,757,400 A * 5/1998 Hoisington ..... 347/40
6,099,108 A * 8/2000 Weber et al. ..... 347/43

FOREIGN PATENT DOCUMENTS

JP A 10-217452 8/1998
JP A 2001-334661 12/2001

* cited by examiner

*Primary Examiner*—Thinh Nguyen

(57) ABSTRACT

Opposing piezoelectric elements bordering a boundary between neighboring nozzle groups have point symmetry. Hence, even if a gap is opened up between actuator units due to necessity in assembly, rows of the nozzles are not offset. Accordingly, even a series of nozzle groups are combined in a conveyance direction of a recording medium, width of an inkjet recording head is not increased. Further, because the rows of nozzles are not offset, there is no requirement to offset discharge timings for each actuator unit, and output of image data does not become complex. Thus, lengthening can basically be implemented with two piezoelectric plates. Consequently, production yields can be improved.

20 Claims, 20 Drawing Sheets

INKJET RECORDING HEAD AND INKJET RECORDING DEVICE

CROSS-REFERENCE TO RELATED APPLICATION

This application claims priority under 35 USC 119 from Japanese Patent Application No. 2003-80949, the disclosures of which are incorporated by reference herein.

BACKGROUND OF THE INVENTION

1. Field of the Invention

The present invention relates to an inkjet recording head and an inkjet recording device.

2. Description of the Related Art

An inkjet recording device records text, images and the like on recording paper by reciprocating an inkjet recording head in a main scanning direction, conveying the recording paper in a sub-scanning direction, and selectively discharging ink droplets from a plurality of nozzles. A technology is well known in which an inkjet recording head discharges an ink droplet from a nozzle that communicates with a pressure chamber by applying pressure, via an oscillating diaphragm, to ink in the pressure chamber by using an actuator such as, for example, a piezoelectric element which converts electrical energy to mechanical energy.

In recent years, the trend for inkjet recording devices to get faster has intensified. Accordingly, inkjet recording heads which are capable of image formation over broader regions in shorter times have been produced by lengthening the inkjet recording heads, increasing the number of nozzles at each inkjet recording head, and arraying the nozzles in matrix patterns (see, for example, Japanese Patent Application Laid-Open (JP-A) No. 2001-334661).

When an inkjet recording head is lengthened and the nozzles are increased in number and arrayed in a matrix pattern as described above, a large number of piezoelectric elements arrayed in the matrix pattern are also required in accordance therewith. This large number of piezoelectric elements arrayed in the matrix pattern are formed by machining, for example, by sandblasting, a single piezoelectric plate (i.e., by machining a piezoelectric material such as a piezoelectric ceramic plate or the like, prior to preparation of the piezoelectric elements). Therefore, the longer the inkjet recording head, the longer the piezoelectric plate for forming the piezoelectric elements. However, making the piezoelectric plate longer and forming the large number of piezoelectric elements arrayed in the matrix pattern is problematic for manufacturing, and leads to a decrease in yields.

Accordingly, a technique has been considered in which a plurality of actuator units, at which the piezoelectric elements are formed, are connected in a row direction of the nozzles for lengthening. With such a structure, the large number of piezoelectric elements are formed so as to be divided up between a plurality of piezoelectric plates. In consequence, the decrease in yields does not result.

However, in a case in which a plurality of actuator units are thus joined for lengthening, problems may arise in assembly if there is no spacing at joining portions thereof. Accordingly, there is a technique in which a plurality of parallelogram-form actuator units are offset in the main scanning direction and a spacing L between the actuator units is assured (see, for example, JP-A No. 10-217452).

However, it is necessary to dispose the parallelogram-form actuator units to be offset in the main scanning direction in order to assure the spacing L between the actuator units. Consequently, the width in the main scanning direction of the inkjet recording head in which the actuator units are joined becomes larger in accordance with lengthening of the inkjet recording head (see FIG. 1 of JP-A No. 10-217452). As a result, the inkjet recording head becomes larger together with the length of the inkjet recording head.

Furthermore, because the nozzle rows are offset in the main scanning direction, it is necessary to offset ink drop discharge timings for each group of nozzles. As a result, the output of image data becomes more complicated.

SUMMARY OF THE INVENTION

The present invention has been devised in order to solve the problems described above, and an object of the present invention is to provide an inkjet recording head and inkjet recording device which improve production yields and enable lengthening of the inkjet recording head while assuring assembly characteristics and not increasing width of the inkjet recording head, and with which output of image data does not become more complicated in accordance with the increase in length.

In a first aspect of the present invention, an inkjet recording head includes: a nozzle plate in which nozzles which eject ink drops are formed; pressure chambers communicating with the nozzles; and actuators abutting at the pressure chambers, which at least one of increase and reduce pressures of ink in the pressure chambers. The inkjet recording head scans in a direction intersecting a conveyance direction of a recording medium and records an image at the recording medium with the ink drops ejected from the nozzles, and includes at least one nozzle row parallel to the conveyance direction of the recording medium. The inkjet recording head includes a plurality of nozzle groups structured by dividing up the nozzle row, the nozzles of the nozzle row include opposing nozzles which are disposed at a boundary between neighboring the nozzle groups which neighbor in the row direction of the nozzle row, the actuators include opposing actuators, which respectively correspond to the opposing nozzles, and actuators within the nozzle groups, which respectively correspond to nozzles neighboring the opposing nozzles in the row direction, and a separation between the opposing actuators disposed at the boundary is equal to or greater than separations between the opposing actuators and the corresponding actuators within the nozzle groups.

According to an inkjet recording head of the present invention, nozzle rows are divided up to structure a plurality of nozzle groups. Hence, the separation between opposing actuators, which respectively correspond to opposing nozzles disposed at a boundary between the nozzle groups which neighbor one another in the row direction of the nozzle rows, is provided so as to be equal to or greater than the separations between actuators within the nozzle groups, which respectively correspond to and are adjacent in the row direction to the nozzles disposed at the boundary, and the actuators corresponding to the nozzles disposed at the boundary.

According to the present aspect, the actuators are formed by machining for each group. When these actuator groups are joined to produce the inkjet recording head, there is naturally no problem with assembly characteristics. Furthermore, because the actuators are formed by machining from a plurality of actuator plates (an actuator material prior to machining of the actuators) which are short in accordance with the nozzle groups, yields are improved.

Further, because the nozzle rows are not offset even though the inkjet recording head is lengthened, the width of the inkjet recording head is not increased even though the number of actuators increases. Moreover, there is no need to offset the discharge timings for each nozzle group, and the output of image data will not become complicated.

In a second aspect of the present invention, an inkjet recording head includes: a nozzle plate in which nozzles which eject ink drops are formed; pressure chambers communicating with the nozzles; and actuators abutting at the pressure chambers, which at least one of increase and reduce pressures of ink in the pressure chambers. The inkjet recording head records an image over the width of a recording medium, which is being conveyed, with the ink drops ejected from the nozzles, and includes at least one nozzle row in a direction intersecting the conveyance direction of the recording medium. The inkjet recording head includes a plurality of nozzle groups structured by dividing up the nozzle row, the nozzles of the nozzle row include opposing nozzles which are disposed at a boundary between neighboring the nozzle groups which neighbor in the row direction of the nozzle row, the actuators include opposing actuators, which respectively correspond to the opposing nozzles, and actuators within the nozzle groups, which respectively correspond to nozzles neighboring the opposing nozzles in the row direction, and a separation between the opposing actuators disposed at the boundary is equal to or greater than separations between the opposing actuators and the corresponding actuators within the nozzle groups.

According to the inkjet recording head of the present aspect, effects similar to those provided by the first aspect are provided. Further, according to the present aspect, the inkjet recording head is fixed but can record images over the width of the recording medium that is being conveyed, and thus an inkjet recording head capable of high-speed printing is provided.

In a third aspect of the present invention, arrangement forms of the nozzles of the nozzle groups of an inkjet recording head of an aspect described above include, if straight lines are taken between the nozzles disposed at outer edges of the nozzle groups, at least one of a triangular form, a parallelogram form and a trapezoid form.

In a fourth aspect of the present invention, the arrangement forms of the nozzle groups of the above-described third aspect include a combination of forms including at least one of the triangular form, the parallelogram form and the trapezoid form.

In a fifth aspect of the present invention, a nozzle pitch of the nozzles of the nozzle groups in the row direction is the same as a spacing between the nozzles disposed at the boundary between the neighboring nozzle groups.

According to an inkjet recording head of the present aspect, results the same as in the aspects described above are provided. Further, because the nozzle pitch in the row direction of the nozzle row of the nozzle groups and the spacing between the opposing nozzles disposed at the boundary of the neighboring nozzle groups in the row direction of the nozzle row are the same, the inkjet recording head is not enlarged in the row direction of the nozzle rows.

In a sixth aspect of the present invention, the opposing actuators of an inkjet recording head of an aspect described above, borders of which oppose the boundary between the neighboring nozzle groups, include point symmetry.

According to the present aspect, the actuators whose borders oppose the boundary of the neighboring nozzle groups have a structure with point symmetry. Thus, a gap is opened up between the opposing actuators. Accordingly, effects the same as in the first to fifth aspects described above are provided.

In a seventh aspect of the present invention, the opposing actuators of an inkjet recording head of an aspect described above, borders of which oppose the boundary between the neighboring nozzle groups, include line symmetry.

According to the present aspect, the actuators whose borders oppose the boundary of the neighboring nozzle groups have a structure with line symmetry. Thus, a gap is opened up between the opposing actuators. Accordingly, effects the same as in the first to fifth aspects described above are provided.

In an eighth aspect of the present invention, the inkjet recording head of the first aspect has an actuator unit for each nozzle group, the actuator unit being structured to include at least the pressure chambers and the actuators respectively corresponding to the nozzles constituting the nozzle groups.

Because, according to the present aspect, an actuator unit structured to include at least the pressure chambers and the actuators respectively corresponding to the nozzles constituting the nozzle group is provided for each nozzle group, actuator characteristics tests for predicting ink drop discharge characteristics can be carried out on each actuator unit prior to assembly. Hence, the occurrence or absence of failures at each actuator unit, characteristics thereof and the like can be found. Therefore, by selecting the actuator units, co-ordinating the characteristics of the actuator units and assembling the same, ink droplet discharge characteristics of the inkjet recording head can be made more uniform.

In a ninth aspect of the present invention, each nozzle group of an inkjet recording head of the above-described eighth aspect is provided with an ink discharge unit including at least the nozzle plate and the actuator unit.

According to the present aspect, the ink discharge unit including at least the nozzle plate and the actuator unit is structured at each nozzle group. Hence, ink drops can be discharged at each ink discharge unit.

Further, because, as described above, the separation in the row direction of the nozzle row between the opposing actuators corresponding to the opposing nozzles disposed at the boundary between the neighboring nozzle groups is relatively large, the ink discharge units can be associated to structure the inkjet recording head without shifting the nozzle rows.

Thus, the inkjet recording head can be lengthened without increasing the width of the inkjet recording head. Further, there is no need to offset the discharge timings at each ink discharge unit, and an increase in complexity of the output of image data is avoided. Moreover, in cases in which problems arise, the ink discharge units can be individually replaced.

In a tenth aspect of the present invention, the actuators of each nozzle group of an inkjet recording head of an aspect described above are disposed with an orientation the same as the actuators disposed at the boundary of the nozzle group.

The actuator units and the ink discharge units have consistent forms. Therefore, in the present aspect, one kind of the actuator units and one kind of the ink discharge units may be associated, and there is no need to prepare two kinds of actuator unit and ink discharge unit. Thus, production costs will not rise.

In an eleventh aspect of the present invention, positions of the actuators within each nozzle group include point symmetry, with a center of the nozzle group as the point of symmetry thereof.

Because, according to the present aspect, the positions of the actuators within the nozzle group include point symmetry with the center of the nozzle group as the point of symmetry, the inkjet recording head can be further lengthened in the row direction. Therefore, in a case in which it is desired to increase the number of nozzles, this can be easily implemented by joining actuator units and ink discharge units in the row direction of the nozzles. Further, given that the actuator units and ink discharge units have the same shapes, the one kinds of actuator units and ink discharge units may be associated. Thus, production costs will not rise.

In a twelfth aspect of the present invention, the actuators include piezoelectric elements for converting electrical energy to mechanical energy.

In a thirteenth aspect of the present invention, the actuators include heat-generating resistors which pressurize the ink in the pressure chambers by heating and causing bubbling.

In a fourteenth aspect of the present invention, an inkjet recording device employs an inkjet recording head of one of the first to thirteenth aspects described above.

In an inkjet recording device based on the present aspect, the width of the inkjet recording head is not increased. Therefore, the inkjet recording device is not made larger.

DETAILED DESCRIPTION OF THE INVENTION

Figure 1A:
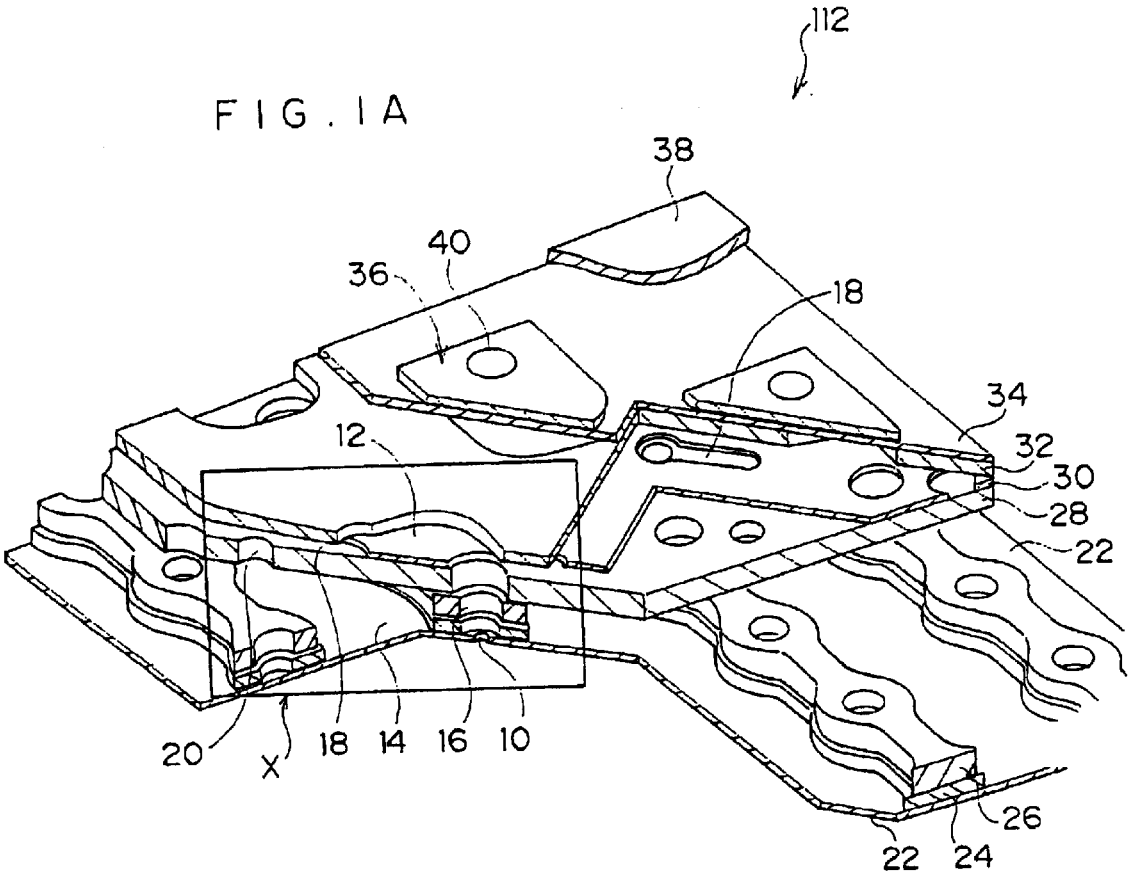
FIG. 1A is a sectional perspective view showing principal elements of an inkjet recording head relating to a first embodiment of the present invention.

Herebelow, a first embodiment of an inkjet recording head relating to the present invention will be described with reference to FIGS. 1 to 6.

As shown in FIGS. 1A, 1B, 2A and 2B, an inkjet recording head 112 is provided with a nozzle 10, a pressure chamber 12, and a common ink chamber 14. The nozzles 10, arranged in a matrix pattern, discharge ink drops, which is described later. The pressure chamber 12 applies pressure to the ink and causes discharge of the ink droplets from the nozzle 10. A shape of the pressure chamber 12 as viewed from a direction of discharge of the ink droplets is formed in a diamond shape. The common ink chamber 14 is charged with ink which is introduced from an unillustrated ink supply section. The inkjet recording head 112 is further provided with a communication chamber 16 and a supply channel 18. The communication chamber 16 communicates between the nozzle 10 and the pressure chamber 12. The supply channel 18 communicates between an opening portion 20 of the common ink chamber 14 and the pressure chamber 12. Further, a diaphragm 34 is fixed at an upper face of the pressure chamber 12. A piezoelectric element 36 is fixed at an upper face of the diaphragm 34. A shape of the piezoelectric element 36 as viewed from the direction of discharge of the ink droplets is a substantially rectangular shape. Further still, a wiring substrate 38 is connected to an upper face of the piezoelectric element 36 via a ball solder 40.

Figure 2A:
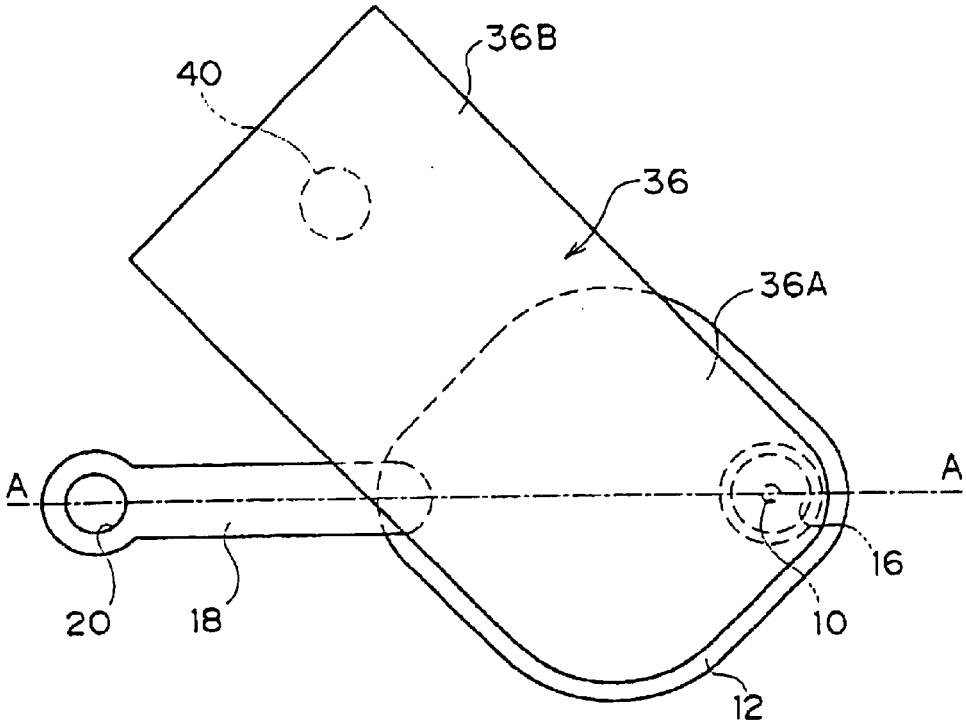
FIG. 2A is a sectional view showing principal elements of the inkjet recording head relating to the first embodiment of the present invention.

As is shown in FIG. 2A, the nozzle 10 is located at a corner portion of the diamond shape of the pressure chamber 12, and the supply channel 18 communicates with a corner portion which is opposite the position of the nozzle 10 along a diagonal of the pressure chamber 12.

The piezoelectric element 36 is divided into a driving portion 36A and an electrode pad portion 36B. The driving portion 36A is a portion which is disposed at an upper face of a region corresponding to the pressure chamber 12, with the diaphragm 34 interposed therebetween. The driving portion 36A has a size slightly smaller than the pressure chamber 12 and is substantially the same shape as the pressure chamber 12. The driving portion 36A distorts, and applies pressure to the ink in the pressure chamber 12 via the diaphragm 34.

The electrode pad portion 36B is a portion which extends from the driving portion 36A to outside the area of the pressure chamber 12. The electrode pad portion 36B is connected with the wiring substrate 38 via the ball solder 40.

Figure 2B:
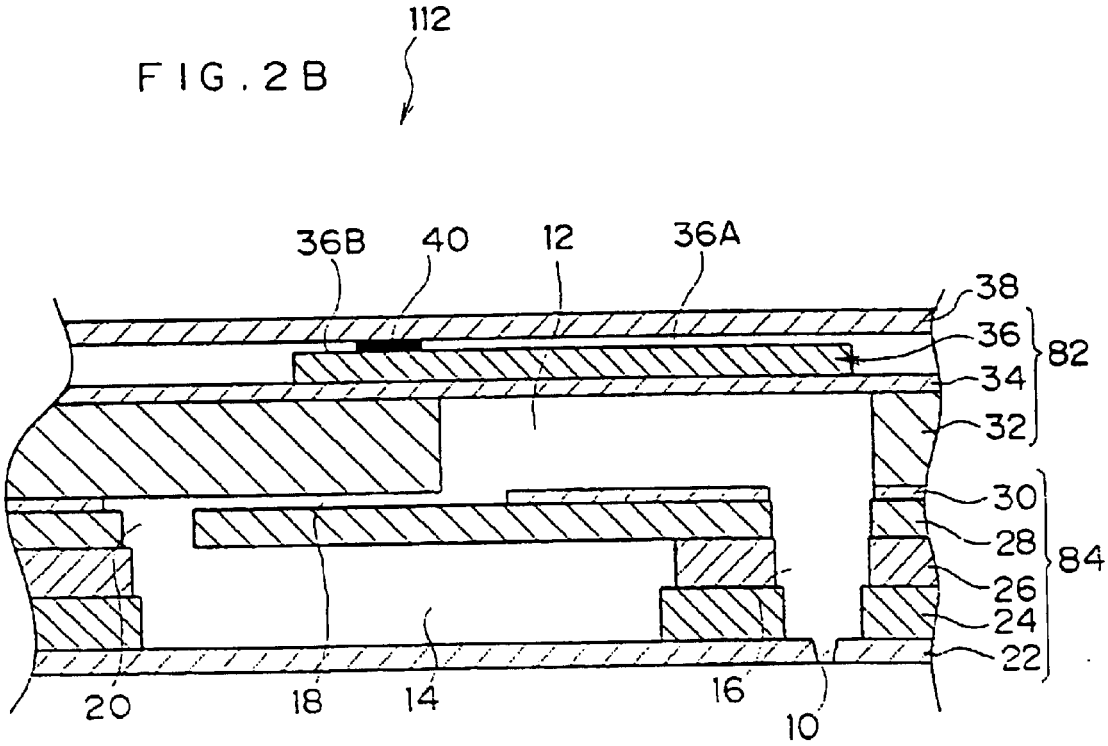
FIG. 2B is a sectional view of the principal elements of the inkjet recording head portion when cut along the line A—A of FIG. 2A.
Figure 5:
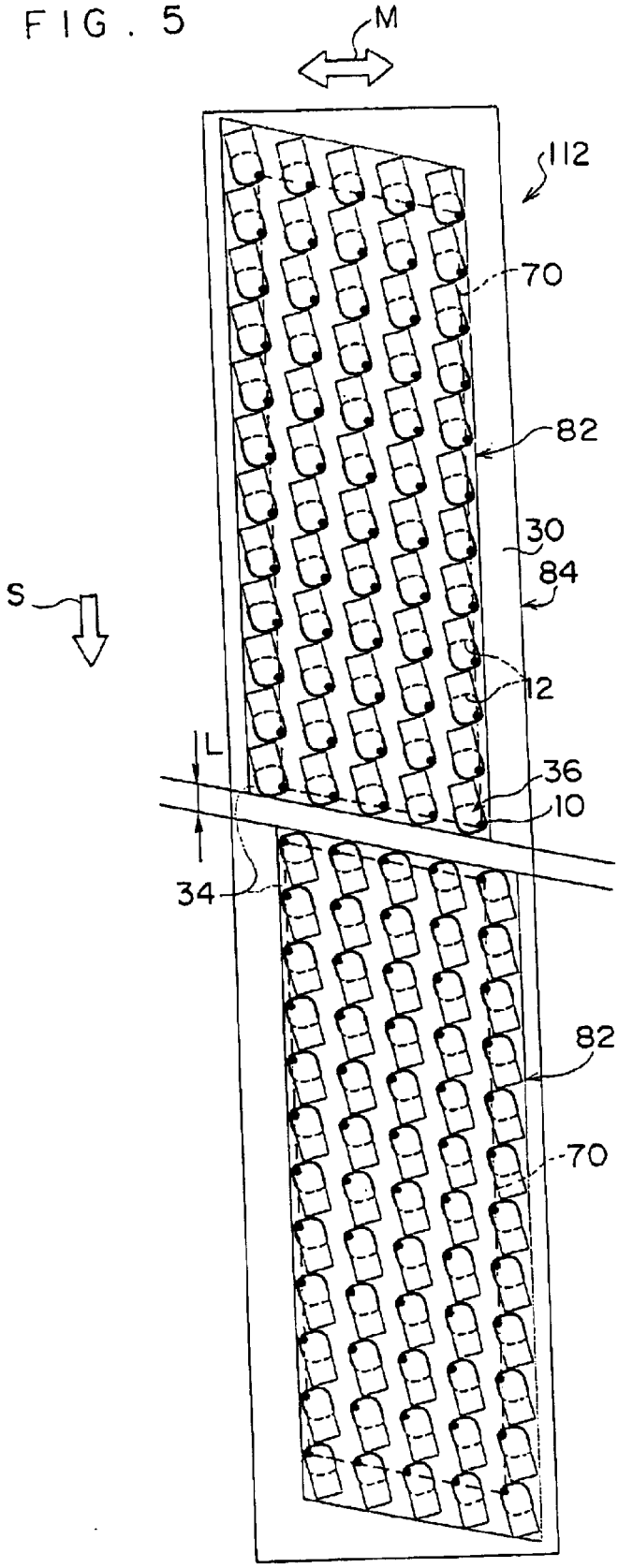
FIG. 5 is a schematic view showing arrangements of nozzles, nozzle groups, actuator units, and piezoelectric elements in the actuator units of the inkjet recording head relating to the first embodiment of the present invention.
Figure 20:
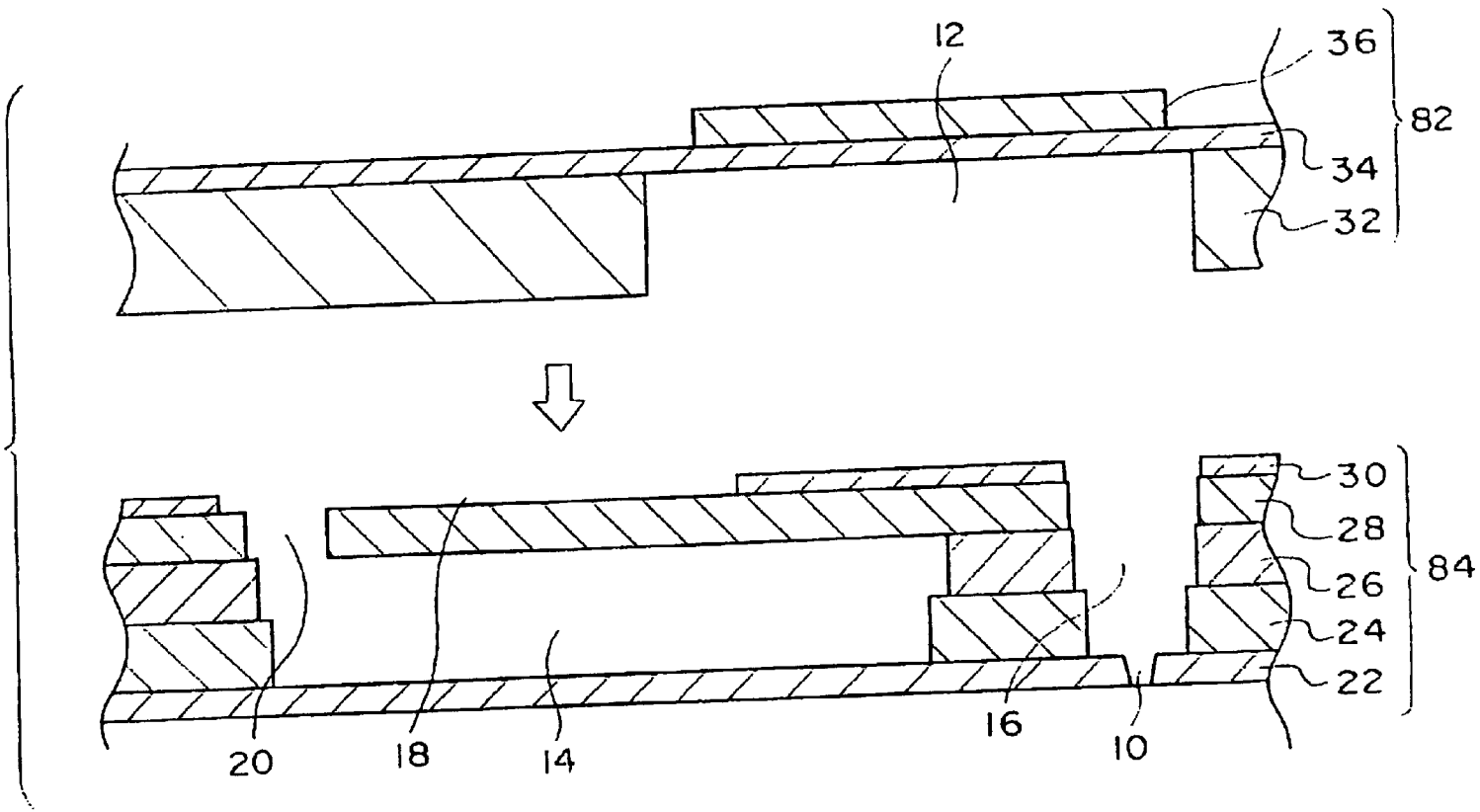
FIG. 20 is a view schematically showing joining of a flow channel unit and an actuator unit.

As is shown in FIG. 5, the nozzles 10 form parallelogram-form nozzle groups 70. As shown in FIG. 20 (a situation prior to joining), a flow channel unit 84 is structured by the communication chambers 16, the supply channels 18 and the common ink chambers 14, which are provided in respective correspondence with the nozzles 10. An actuator unit 82 is structured by the pressure chambers 12, the diaphragms 34 and the piezoelectric elements 36, which are provided in respective correspondence with the nozzles 10 of each nozzle group 70. Hence, the flow channel unit 84 and the actuator unit 82 are joined, are connected with the wiring substrate 38 via the ball solder 40 as shown in FIG. 2B, and are assembled to an unillustrated ink supply section and the like to form the inkjet recording head 112.

Next, a process for production of the inkjet recording head 112 of the present embodiment will be described.

First, a process for production of the flow channel unit 84 will be described.

As shown in FIG. 20, a nozzle plate 22, ink pooling plates 24 and 26, a through plate 28 and an ink supply channel plate 30 are laminated, in this order, and joined. The nozzle 10 is formed in the nozzle plate 22. The ink pooling plates 24 and 26 contribute to formation of the communication chamber 16 and the common ink chamber 14. The through plate 28 contributes to formation of the communication chamber 16 and the opening portion 20 of the common ink chamber 14. The supply channel 18 is formed in the ink supply channel plate 30.

Then, a front face of the nozzle plate 22 is covered with a water-repellent coating layer and the nozzles 10 are opened by an excimer laser.

A material of the nozzle plate 22 is a polyimide, and materials of the ink pooling plate 24, the ink pooling plate 26, the through plate 28 and the ink supply channel plate 30 are SUS. As mentioned above, the component in which these plates are laminated and joined is the flow channel unit 84.

Figure 3A:
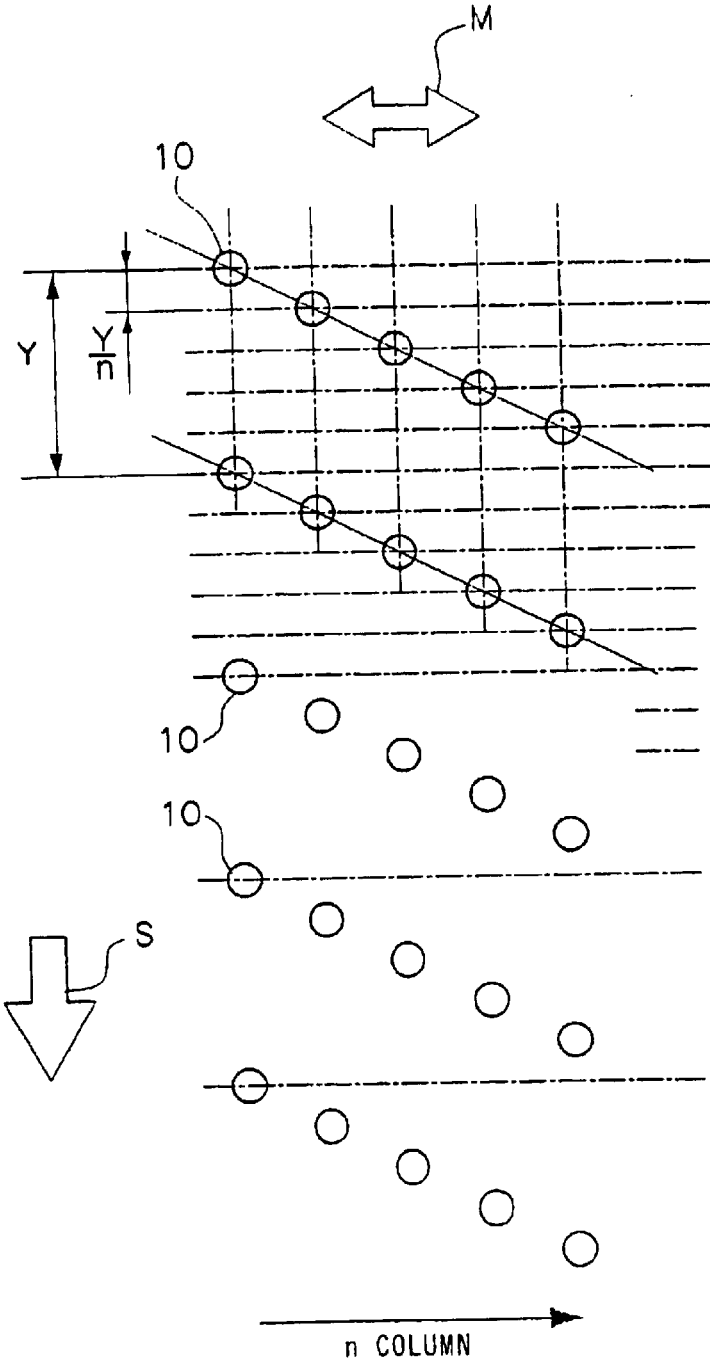
FIG. 3A and FIG. 3B are explanatory views for explaining a nozzle arrangement of the inkjet recording head relating to the first embodiment of the present invention.

An arrangement of the nozzles 10, which are arrayed in a matrix pattern, will now be described. As shown in FIGS. 3 and 4, the nozzles 10 are lined up with equal spacings, with a spacing Y in a direction S which intersects a main scanning direction M (see FIG. 11), which will be discussed later. Note that a line of the nozzles 10 in the direction S intersecting the main scanning direction M is a "row", and a line in the main scanning direction M is a "column". The rows of the nozzles 10 are lined up in n rows (five rows in FIGS. 3 and 4) which are equally spaced in the main scanning direction M with a spacing larger than the size of the pressure chambers 12. Each row of the nozzles 10 is successively offset in the direction S intersecting the main scanning direction M by a spacing Y/n, which is smaller than the size of the pressure chambers 12.

Figure 3B:
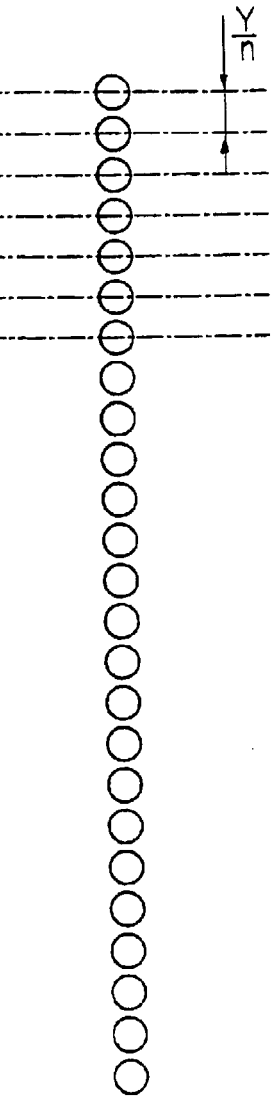
Figure 4:
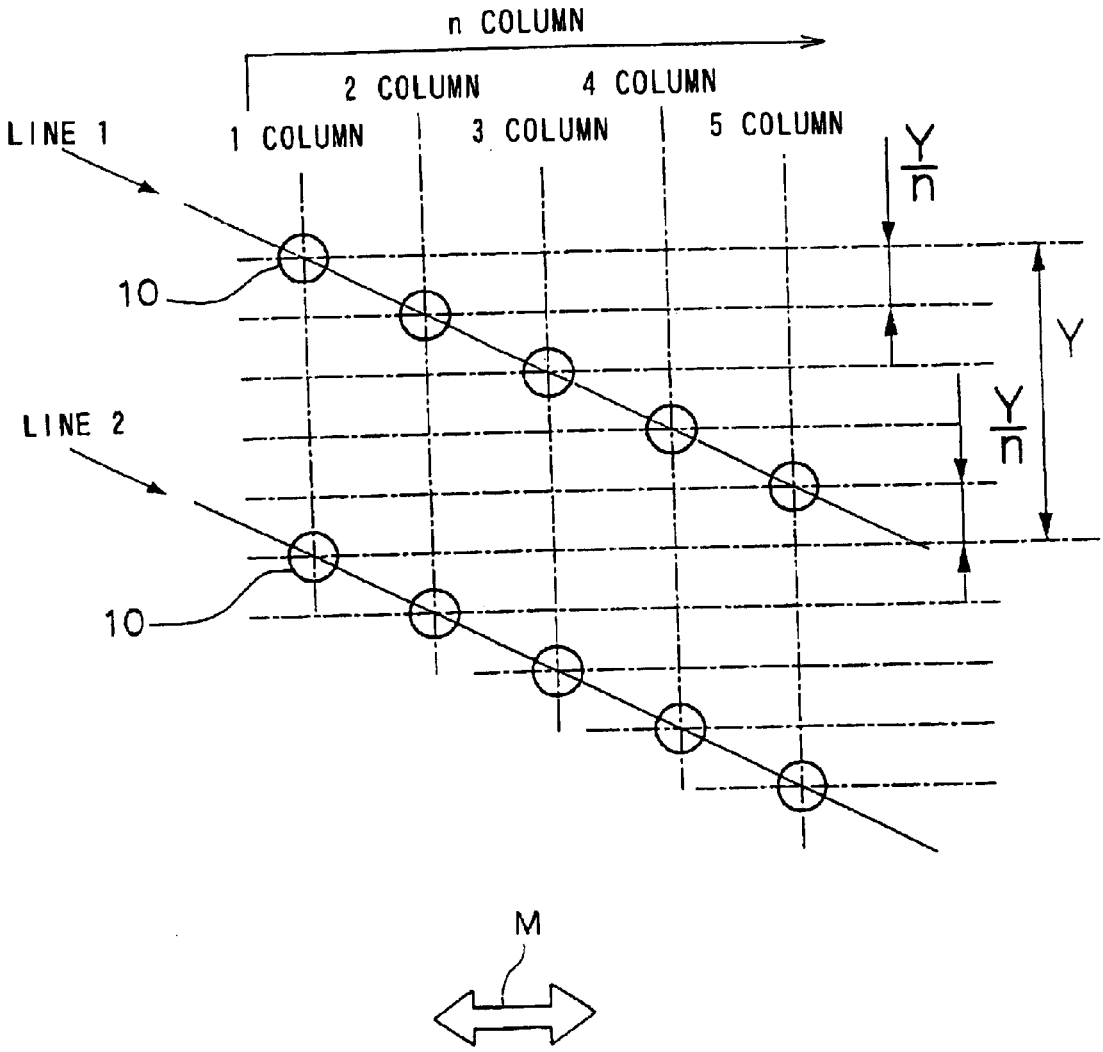
FIG. 4 is an enlarged view of FIG. 3A.

Accordingly, if projected in the main scanning direction M, the nozzles 10 are lined up with pitch Y/n as shown in FIG. 3B, and the inkjet recording head 112 with a high resolution can be realized. When the inkjet recording head 112 moves in the main scanning direction M, a straight row of dots can be formed on a recording paper P (see FIG. 11) by controlling the discharge timings of the ink droplets for each row of the nozzles 10.

In the present embodiment, as shown in FIG. 5, the nozzles 10 are arranged in a matrix pattern of 5 rows by 24 columns, and the nozzles 10 are constituted by two 5-row by 12-column nozzle groups 70. If the nozzles 10 which are disposed at outer edges of the nozzle groups 70 are joined by straight lines, the shapes thereof are parallelogram forms. The actuator unit 82 is included one for each of the nozzle groups 70. That is, in the present embodiment, the inkjet recording head 112 is structured by assembling two of the actuator units 82 to one of the flow channel unit 84.

Figure 17B:
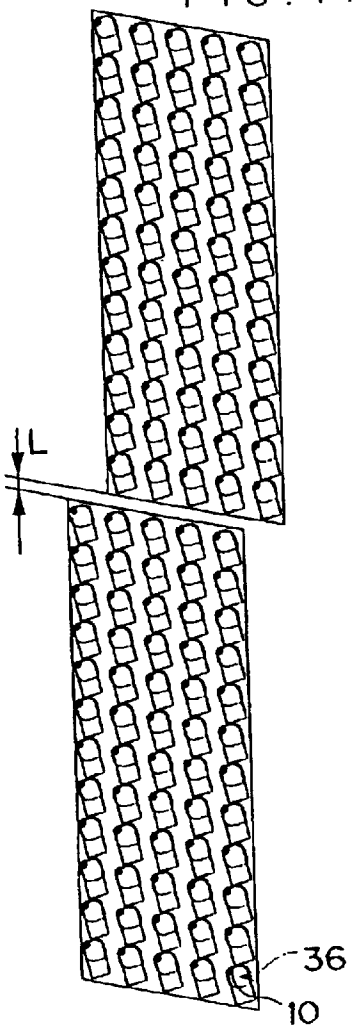
FIG. 17A and FIG. 17B are explanatory views for explaining an arrangement of piezoelectric elements of a conventional inkjet recording head, and a method in which two actuator units are offset and a gap is formed between the actuator units.
Figure 17A:
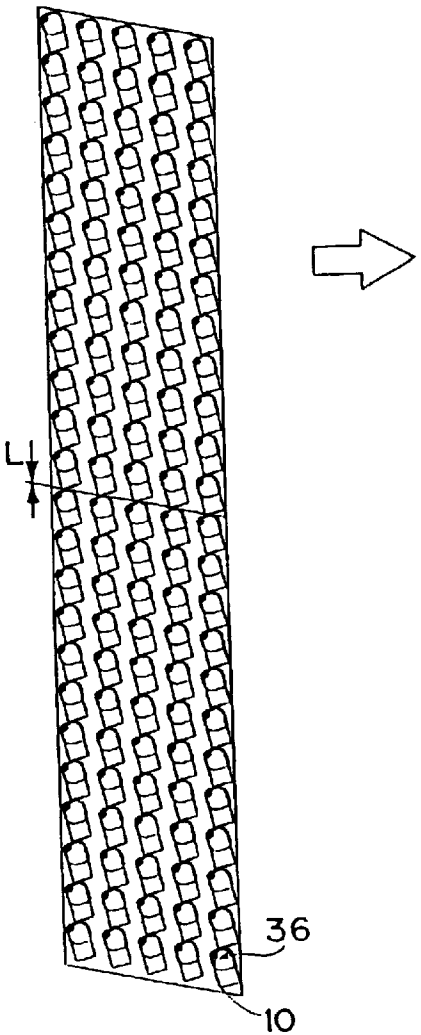

With an assembly which is simply divided between two actuator units as shown in FIG. 17A, a spacing L does not occur. Accordingly, it is necessary to assure the spacing L by offsetting the actuator units in the direction of the arrow, as shown in FIG. 17B. As a result, the nozzle rows are offset between the actuator units. In addition, the width of the inkjet recording head is increased.

Figure 6:
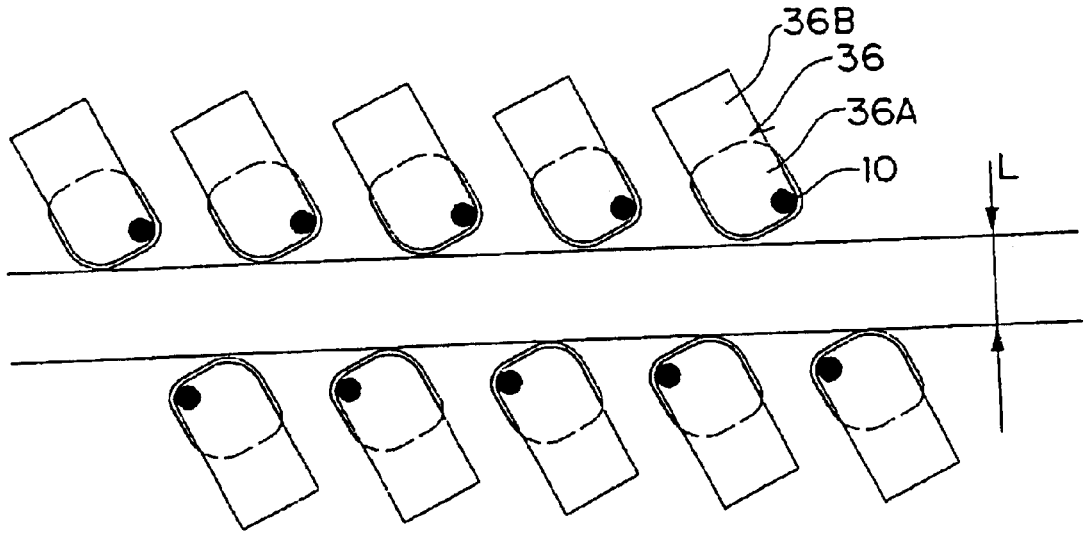
FIG. 6 is a schematic view showing how piezoelectric elements are disposed in point symmetry with respect to points on a boundary of neighboring actuator units (nozzle groups) of the inkjet recording head relating to the first embodiment of the present invention.

In contrast, in the present embodiment, as shown in FIGS. 5 and 6, the piezoelectric elements 36 whose borders oppose a boundary of the neighboring nozzle groups 70 are lined up in point symmetry. In these opposing piezoelectric elements 36, the corner portions thereof at which the nozzles 10 are located are disposed near the boundary, and the piezoelectric pat portion 36B extend to sides away from the boundary. Further, each of the piezoelectric elements 36 within each actuator unit 82 is disposed to match the orientation of the opposing piezoelectric elements 36 (and the nozzles 10, the communication chambers 16, the pressure chambers 12, the ink supply channels 18 and the like are lined up the same way so as to accord with the piezoelectric elements 36). Therefore, the gap L can be opened up between the neighboring actuator units 82 without the piezoelectric elements 36 whose borders oppose the boundary of the nozzle groups 70 interfering, even if the actuator units 82 are joined without offsetting the rows of the nozzles 10. Thus, problems with assembly will not arise.

Next, a process for production of the actuator unit 82 will be described.

First, an unillustrated piezoelectric plate is adhered to an unillustrated fixation support by a removable adhesive, for example, a heat-foaming adhesive film which has a characteristic of foaming and greatly decreasing in adhesive strength when heated to a predetermined temperature after adhesion. Then the piezoelectric elements 36 arranged in the matrix pattern are prepared at the piezoelectric plate by using, for example, sandblasting.

As shown in FIG. 20, the diaphragm 34 is joined to a face of the piezoelectric element 36 which is opposite from a face of the piezoelectric element 36 at which the fixation support is disposed. A pressure chamber plate 32, in which the pressure chamber 12 is formed, is joined to this diaphragm 34. Materials of the pressure chamber plate 32 and diaphragm 34 are SUS.

First and second electrode layers, which serve as electrode layers, are formed beforehand at both faces of the piezoelectric element 36 by sputtering or the like. By joining the diaphragm 34 which is to be multi-functionally used as a common electrode, and the first electrode, with a conductive adhesive, the first electrode layer, i.e., the piezoelectric element 36, is electrically connected with the diaphragm 34.

Thereafter, the fixation support is heated, the adhesive power of the heat-foaming adhesive film is reduced, and the fixation support is detached.

The component in which the piezoelectric element 36, the diaphragm 34 and the pressure chamber plate 32 are thus joined is referred to as the actuator unit 82 as described above.

As mentioned above, that is, as shown in FIG. 20, there are two of the actuator units 82, corresponding to the nozzle groups 70. These two actuator units 82 are brought together and joined to the flow channel unit 84 to prepare the inkjet recording head 112. It is possible to join the two actuator units 82 to the flow channel unit 84 in this manner without offsetting the rows of nozzles 10, as described above, because the piezoelectric elements 36 whose borders face the boundary between the neighboring nozzle groups 70 have point symmetry, the gap L is opened up between the neighboring actuator units 82, and problems do not arise in assembly.

Because these (for example, sixty in the present embodiment) piezoelectric elements 36 are respectively formed at the two actuator units 82, the piezoelectric plates are short. Therefore, even if the inkjet recording head 112 is lengthened, there is no need for the piezoelectric elements 36 to be machined from a single long piezoelectric plate, and the inkjet recording head 112 can be implemented by two short piezoelectric plates. Consequently, production yields are improved.

Because the actuator units 82 are the same shape, a single type of the actuator units 82 may be associated, and production costs do not rise.

Further, even though two of the actuator units 82 are associated, because the actuator units 82 can be joined without offsetting the rows of the nozzles 10, the width of the inkjet recording head 112 does not increase.

Further still, after completion of the actuator units 82, piezoelectric element characteristics tests for predicting ink drop discharge characteristics can be carried out on each actuator unit 82. Thus, the occurrence or absence of failures at each actuator unit 82, characteristics thereof and the like can be found out before assembly to the flow channel unit 84. Therefore, by appropriately selecting the actuator units 82, co-ordinating the characteristics of the actuator units 82 and assembling the same, ink droplet discharge characteristics of the inkjet recording head 112 can be made uniform.

Then, after the actuator units 82 have been associated and joined with the flow channel unit 84 as shown in FIG. 20, the wiring substrate 38, at which the ball solders 40 are formed one for each piezoelectric element 36, is joined to the piezoelectric elements 36 as shown in FIG. 2B. Because the first and second electrode layers are formed at the two faces of the piezoelectric element 36 as mentioned earlier, the second electrode layer, which is to say the piezoelectric element 36, is electrically connected with the wiring substrate 38. The wiring substrate 38 is further connected with the diaphragm 34 by a conductive member.

Finally, an unillustrated ink supply section and the like are assembled, and thus the inkjet recording head 112 of the present embodiment is completed.

Next, operation of the inkjet recording head 112 of the present embodiment will be described.

Figure 1B:
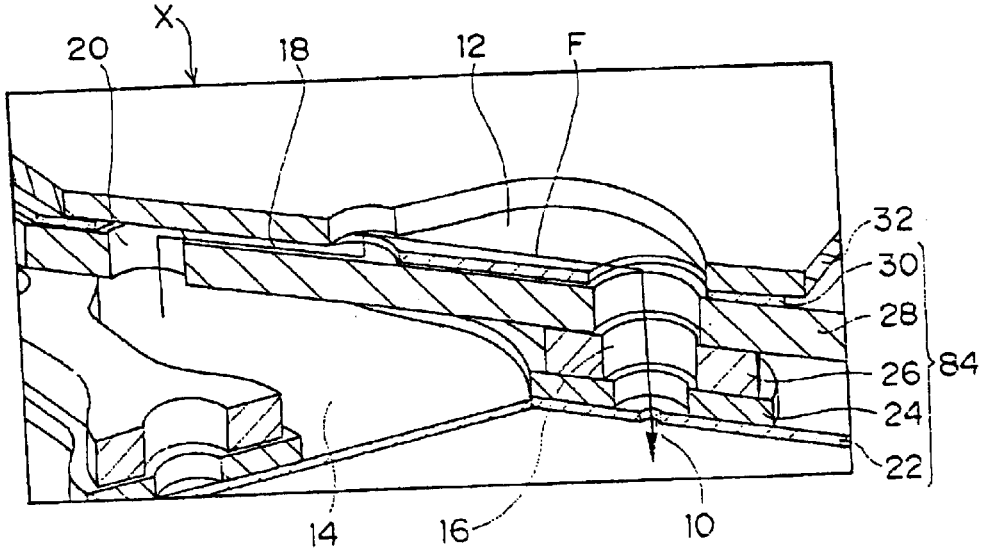
FIG. 1B is an enlarged view of portion X of FIG. 1A.

As shown by arrow F in FIG. 1B, ink introduced from the unillustrated ink supply section of the inkjet recording head 112 is charged into the common ink chamber 14. This ink is charged from the common ink chamber 14, through the supply channels 18, to each pressure chamber 12. In the state in which the ink has been charged into each pressure chamber 12, the driving portions 36A of the piezoelectric elements 36 are warped by, for example, passing current from the ball solders 40 to the piezoelectric elements 36. The ink in the pressure chambers 12 is pressurized via the diaphragms 34, and ink drops are discharged from the nozzles 10.

As shown in FIG. 5, the nozzles 10 are arrayed in rows and columns in the matrix pattern. Because the two actuator units 82 can be associated and joined without offsetting the rows of the nozzles 10, the width of the inkjet recording head 112 is not increased.

Further, because the nozzle rows are not offset, there is no need to offset the discharge timings of the nozzle groups 70, and output of image data does not become complicated.

Figure 7:
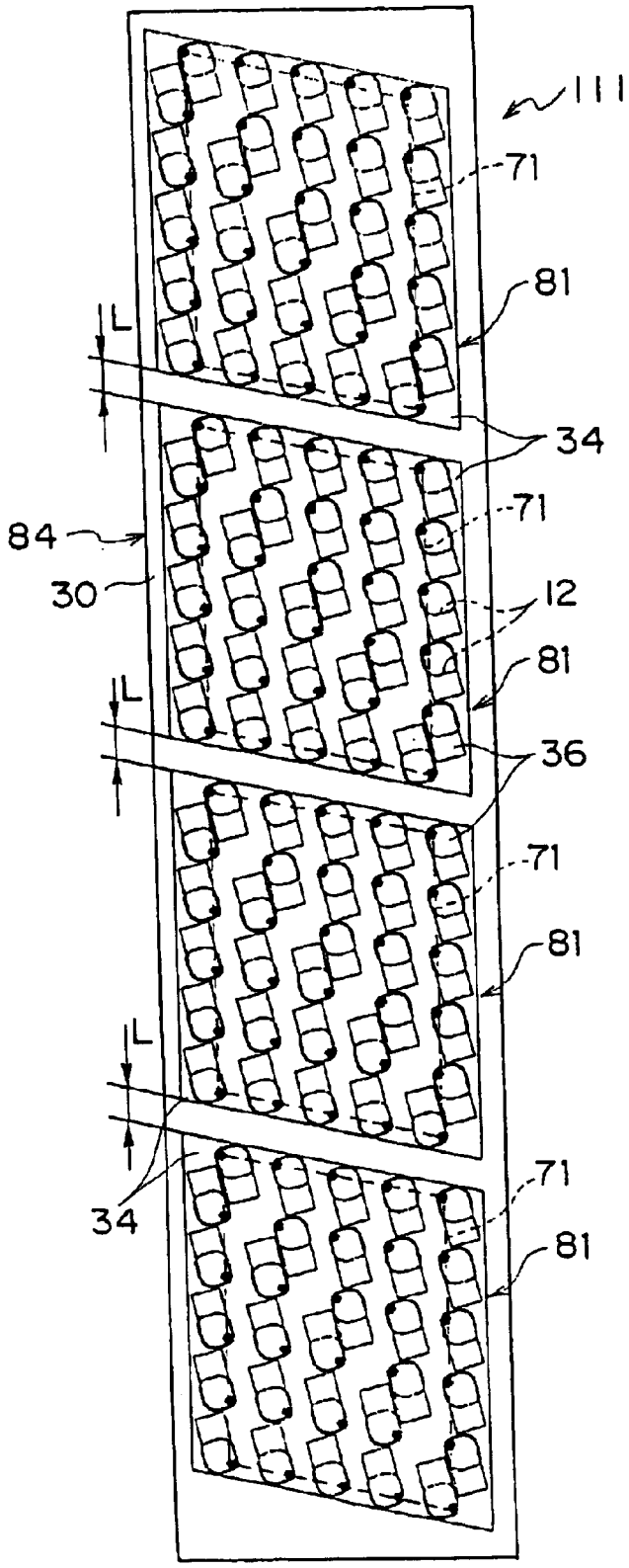
FIG. 7 is a schematic view showing arrangements of nozzles, nozzle groups, actuator units, and piezoelectric elements in the actuator units of an inkjet recording head relating to a second embodiment of the present invention.

Next, a second embodiment relating to the present invention will be described with reference to FIGS. 7 and 8.

Note that members described for the first embodiment are given the same reference numerals, and duplicative descriptions are omitted.

In the first embodiment, the nozzles 10 are disposed in a 5-row by 24-column matrix, and are constituted by the two 5-row by 12-column nozzle groups 70, the shapes formed by the nozzles 10 disposed at outer edges of the nozzle groups being parallelogram shapes. However, in the second embodiment, as shown in FIG. 7, the nozzles 10 are constituted by four 5-row by 6-column nozzle groups 71. If the nozzles 10 disposed at the outer edges of these nozzle groups 71 are joined by straight lines, the forms thereof are also parallelogram shapes. An actuator unit 81 is included for each nozzle group 71. That is, in the present embodiment, an inkjet recording head 111 is structured by assembling four of the actuator units 81 to one of the flow channel unit 84.

Similarly to the first embodiment as shown in FIG. 6, the piezoelectric elements 36 whose borders oppose boundaries between the neighboring nozzle groups 71 have point symmetry. Further, as shown in FIG. 8, positions of the piezoelectric elements 36 in each actuator unit 81 have point symmetry with a center point O of the parallelogram shape serving as the point of symmetry (and the nozzles 10, the communication chambers 16, the pressure chambers 12, the supply channels 18 and the like are lined up the same ways so as to accord with the piezoelectric elements 36). Because the piezoelectric elements 36 are arranged in this manner, the piezoelectric elements 36 of one nozzle group are lined up to oppose the piezoelectric elements 36 of another nozzle group with point symmetry, at both upper and lower boundaries of the actuator units 81 (or the nozzle group 71), as shown in FIG. 7.

Accordingly, similarly to the first embodiment, even though the four of the actuator units 81 are joined without the rows of the nozzles 10 being offset, the gap L is opened up between the neighboring actuator units 81. Hence, there is not a problem with assembly. Thus, it is possible to associate and join four of the actuator units 81 with one of the flow channel unit 84 to produce the inkjet recording head 111.

Because these (for example, thirty in the present embodiment) piezoelectric elements 36 are formed at each of the four actuator units 81, the piezoelectric plates are even shorter than in the first embodiment. Thus, because implementation with four short piezoelectric plates is possible, production yields are further improved.

Moreover, when, after completion of the actuator units 81, characteristics tests are carried out on each actuator unit 81, and the actuator units 81 are selected, co-ordinated for characteristics and assembled, characteristics can be made even more uniform due to structuring with the four actuator units 81.

In the present embodiment, the four 5-row by 6-column actuator units 81 are joined in the direction of the rows of the nozzle 10 for structuring. However, given the actuator unit 81 with the arrangement of the piezoelectric elements 36 of the present embodiment, it is possible for more than four of the actuator units 81 to be joined in the row direction S of the nozzles 10.

Therefore, even if the nozzles 10 are further increased in number and the inkjet recording head is made longer, the size of the actuator units 81 does not become larger. Thus, even with further lengthening, production yields do not deteriorate. Furthermore, if each actuator unit 81 is co-ordinated for characteristics and then assembled, the ink discharge characteristics can be made uniform.

Further still, because there is no shifting from side to side of the actuator units 81 in the row direction S of the nozzles, the width of the inkjet recording head 111 does not become larger than in the first embodiment.

Figure 8:
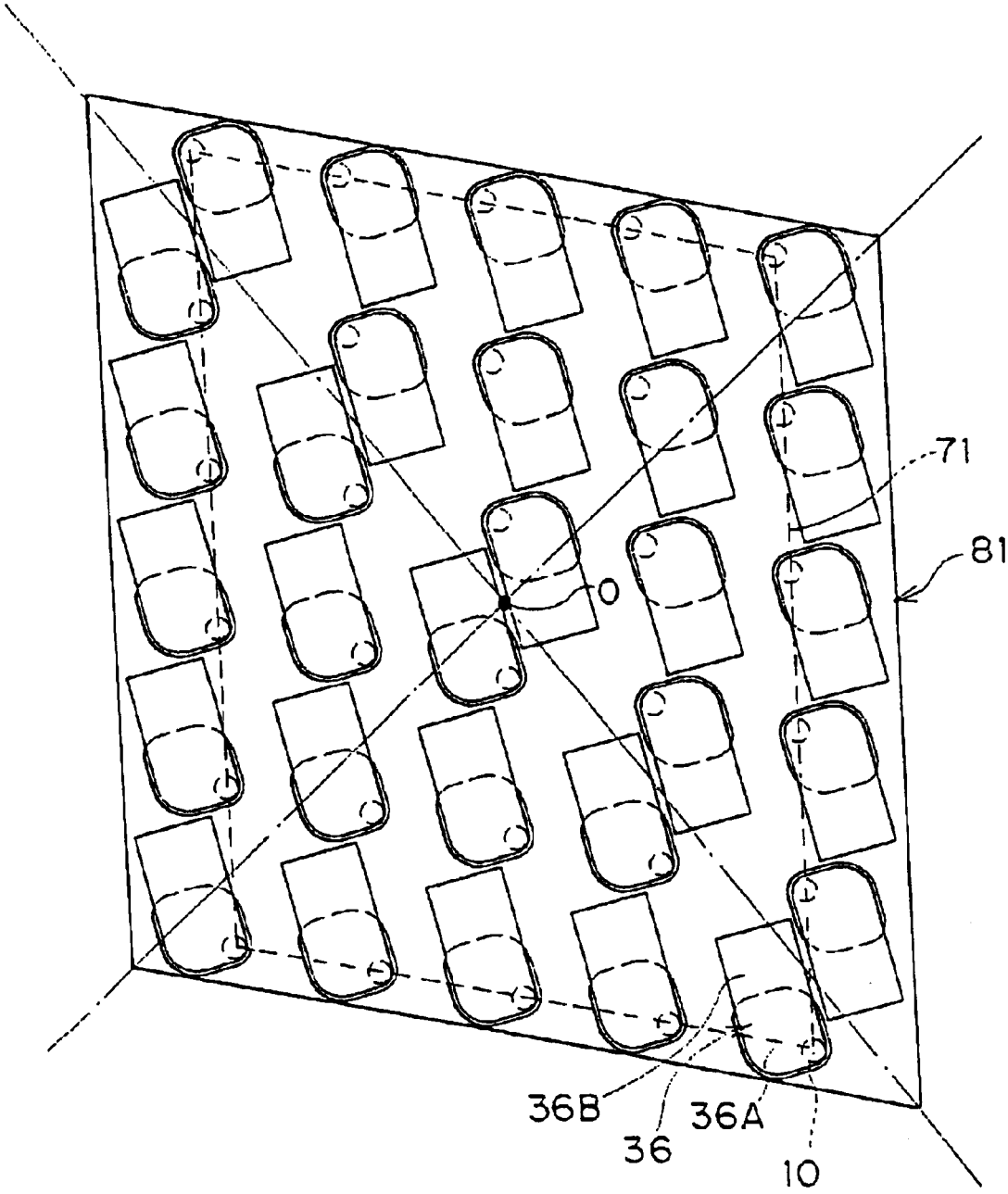
FIG. 8 is a schematic view of an arrangement of the piezoelectric elements in the actuator units of the inkjet recording head relating to the second embodiment of the present invention.
Figure 18B:
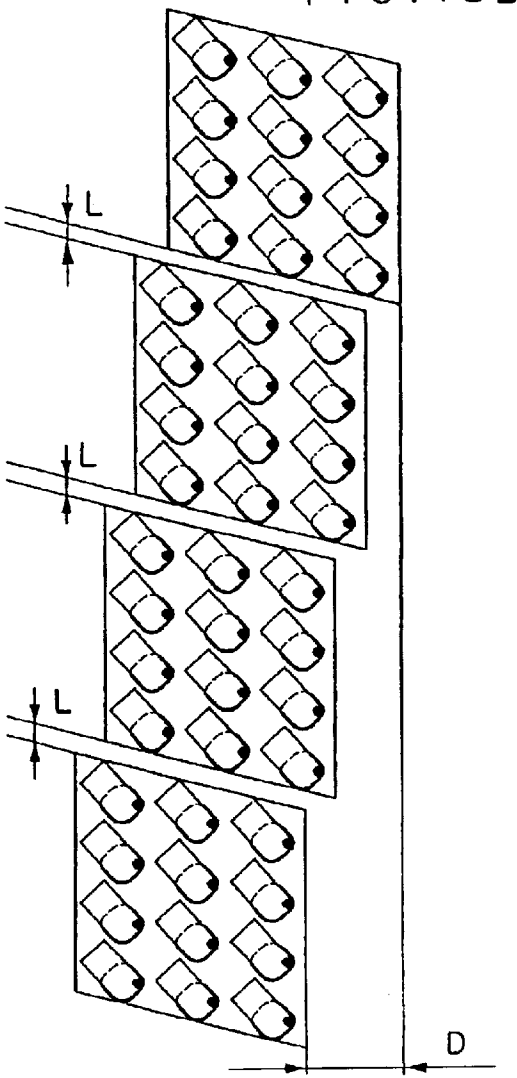
FIG. 18A and FIG. 18B are explanatory views for explaining that width of an inkjet recording head increases when gaps are formed between parallelogram-form actuator units by the actuator units being disposed to be offset as in FIG. 17B.
Figure 18A:
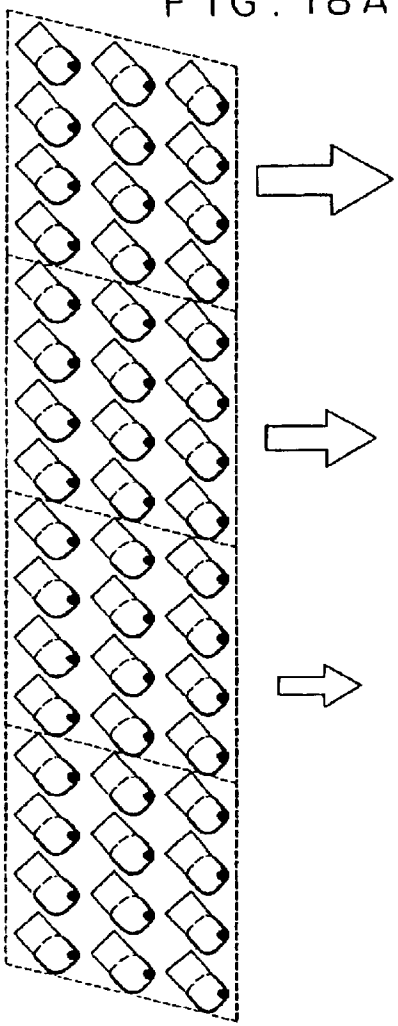

Now, in a case in which, as shown in FIG. 18A, an arrangement of the piezoelectric elements 36 in the actuator units 81 does not have point symmetry with the center points O of the parallelogram shapes serving as the points of symmetry as shown in FIG. 8, it is necessary to have an arrangement which is shifted in the main scanning direction, as shown in FIG. 18B. In this case, the width of the inkjet recording head in the main scanning direction will become larger in accordance with linking of the actuator units and lengthening of the inkjet recording head.

Features apart from the above-mentioned are the same as in the first embodiment, including the method of production.

Operation of the inkjet recording head 111 of the present embodiment is performed in the same way as for the first embodiment.

Next, a third embodiment relating to the present invention will be described with reference to FIGS. 9 and 10.

Note that members described for the first and second embodiments are given the same reference numerals, and duplicative descriptions are omitted.

In the first embodiment and the second embodiment, the piezoelectric element 36 is divided into the driving portion 36A and the electrode pad portion 36B. In the present embodiment however, the electrode pad portion 36B is not provided.

Figure 9A:
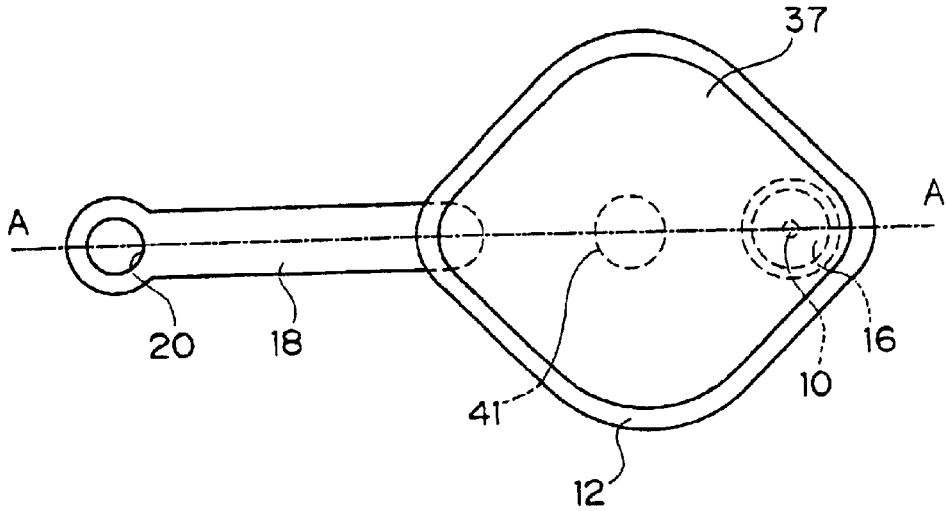
FIG. 9A is a sectional view showing principal elements of an inkjet recording head relating to a third embodiment of the present invention.
Figure 9B:
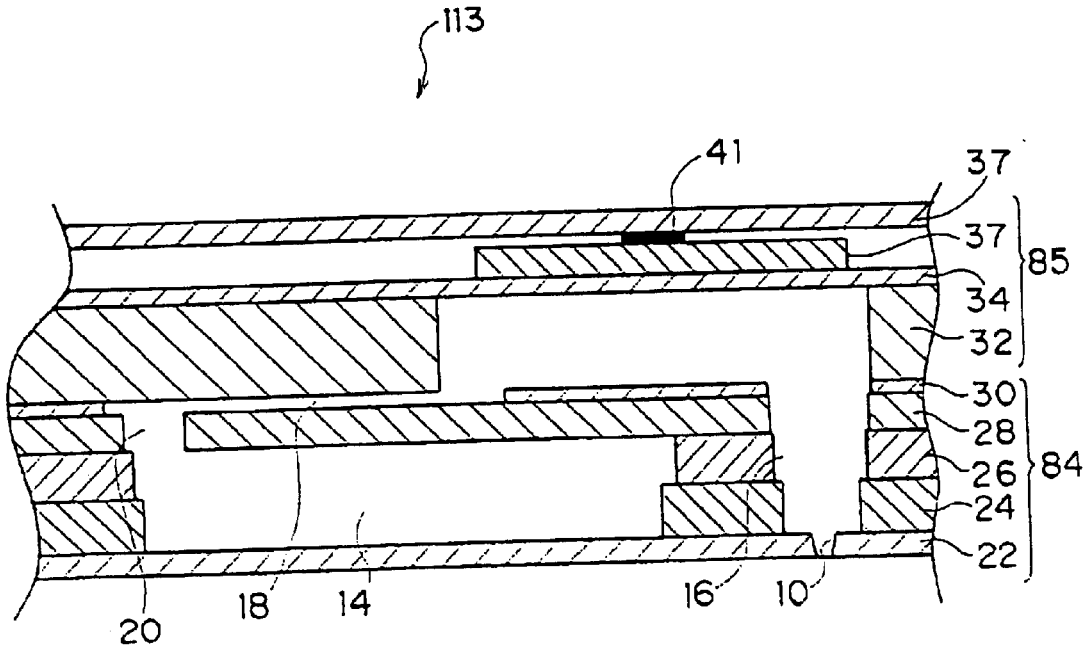
FIG. 9B is a sectional view of the principal elements of an inkjet recording head portion when cut along the line A—A of FIG. 9A.
Figure 10:
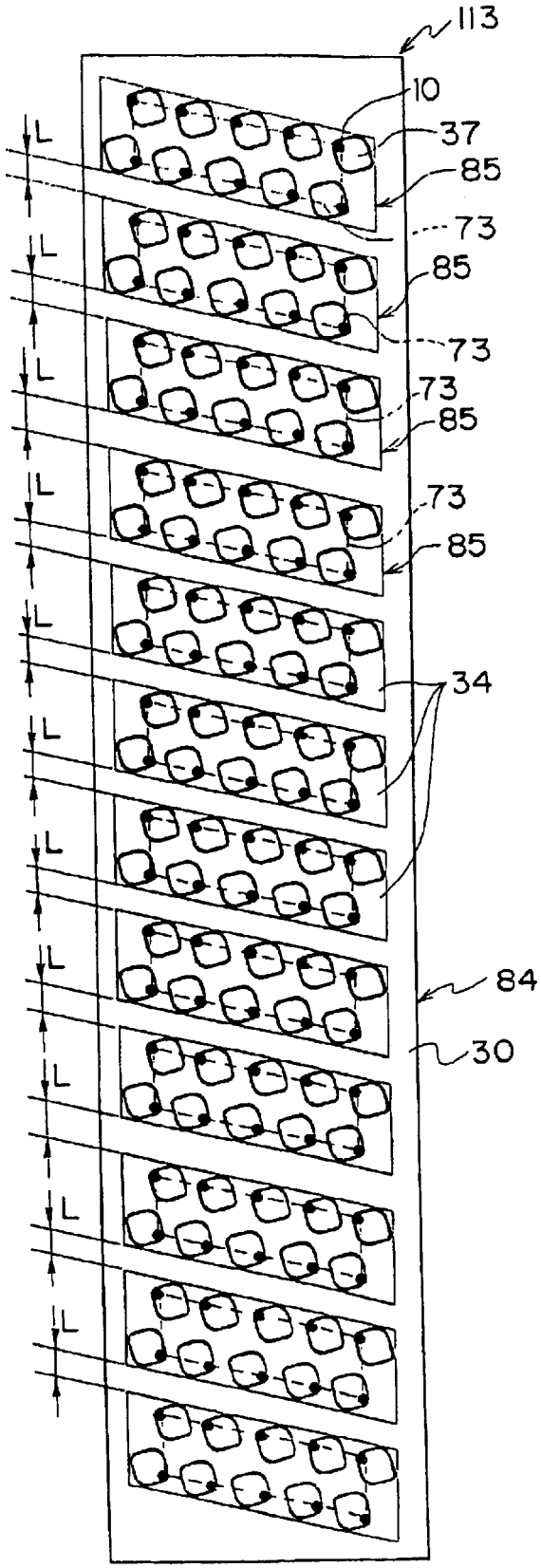
FIG. 10 is a schematic view showing the inkjet recording head relating to the third embodiment of the present invention, which shows arrangements of nozzles, nozzle groups, actuator units, and piezoelectric elements in the actuator units.

Specifically, as shown in FIGS. 9A, 9B and 10, a piezoelectric element 37 is structured only by a driving portion, which is multi-functionally used as an electrode pad portion. The piezoelectric element 37 is provided at the upper face of the region corresponding to the pressure chamber 12, with the diaphragm 34 interposed therebetween, and the size of the piezoelectric element 37 is slightly smaller than the pressure chamber 12. The piezoelectric element 37 is substantially the same shape as the pressure chamber 12. A ball solder is provided on the piezoelectric element 37.

Because the piezoelectric element 37 is given this form, the piezoelectric element 37 can be arranged with a higher density. Thus, division into a greater number of nozzle groups is possible.

In the present embodiment, as shown in FIG. 10, the nozzles 10, which are arranged in a 5-row by 24-column matrix pattern, are constituted by twelve nozzle groups 73 of two columns each. An actuator unit 85 is included for each nozzle group 73. In other words, in the present embodiment, an inkjet recording head 113 is structured by assembling twelve of the actuator units 85 to one of the flow channel unit 84.

Similarly to the second embodiment, the piezoelectric elements 37 bordering boundaries between the neighboring nozzle groups 73 are lined up such that corner portions thereof, at which the nozzles 10 of the pressure chambers 12 are positioned, are located in boundary vicinities. The piezoelectric elements 37 are point-symmetry with a center point on the border at the boundaries of two adjacent nozzle groups 73. Furthermore, the arrangements of the piezoelectric elements 37 within the actuator units 85 have point symmetry with center points of the parallelogram shapes serving as the points of symmetry (and the nozzles 10, the communication chambers 16, the pressure chambers 12, the supply channels 18 and the like are lined up the same way so as to accord with the piezoelectric elements 37).

Thus, similarly to the first and second embodiments, the spacing L is opened up between the neighboring actuator units 85 even though the actuator units 85 are joined without offsetting the rows of the nozzles 10. Therefore, there will not be a problem with assembly. Accordingly, it is possible to associate and join twelve of the actuator units 85 with one of the flow channel unit 84 to produce the inkjet recording head 113.

Because these (for example, ten in the present embodiment) piezoelectric elements 36 are formed at each of the twelve actuator units 85, the piezoelectric plates are even shorter than in the first and second embodiments. Thus, because implementation with the twelve short piezoelectric plates is possible, production yields are yet further improved.

Further, because the actuator units 85 are the same shape, a single type of the actuator units 85 may be associated, and costs do not rise.

Further still, even though twelve of the actuator units 85 are associated, the actuator units 85 can be joined without offsetting the nozzle rows, similarly to the first and second embodiments. Thus, the width of the inkjet recording head 113 does not increase.

Moreover, if, after completion of the actuator units 85, characteristics tests are carried out on each actuator unit 85, and the actuator units 85 are selected, co-ordinated for characteristics and assembled, characteristics can be made even more uniform due to structuring with the twelve actuator units 85.

The present embodiment is formed with twelve of the actuator units 85. However, given the actuator units 85 with the arrangements of the piezoelectric elements 37 of the present embodiment, it is possible for even more of the actuator units 85 to be joined in the row direction S of the nozzles 10.

Therefore, even if, for further lengthening, the nozzles 10 are increased in number and length is increased, the size of the actuator units 85 does not become larger. Thus, even with further lengthening, production yields do not deteriorate. Furthermore, when each actuator unit 85 is co-ordinated for characteristics and assembled, the ink discharge characteristics can be made uniform. Further still, the width of the inkjet recording head will not become larger.

Features apart from the above-mentioned are the same as in the first and second embodiments, including the method of production.

Operation of the inkjet recording head 113 of the present embodiment is performed in the same way as for the first and second embodiments.

Figure 11:
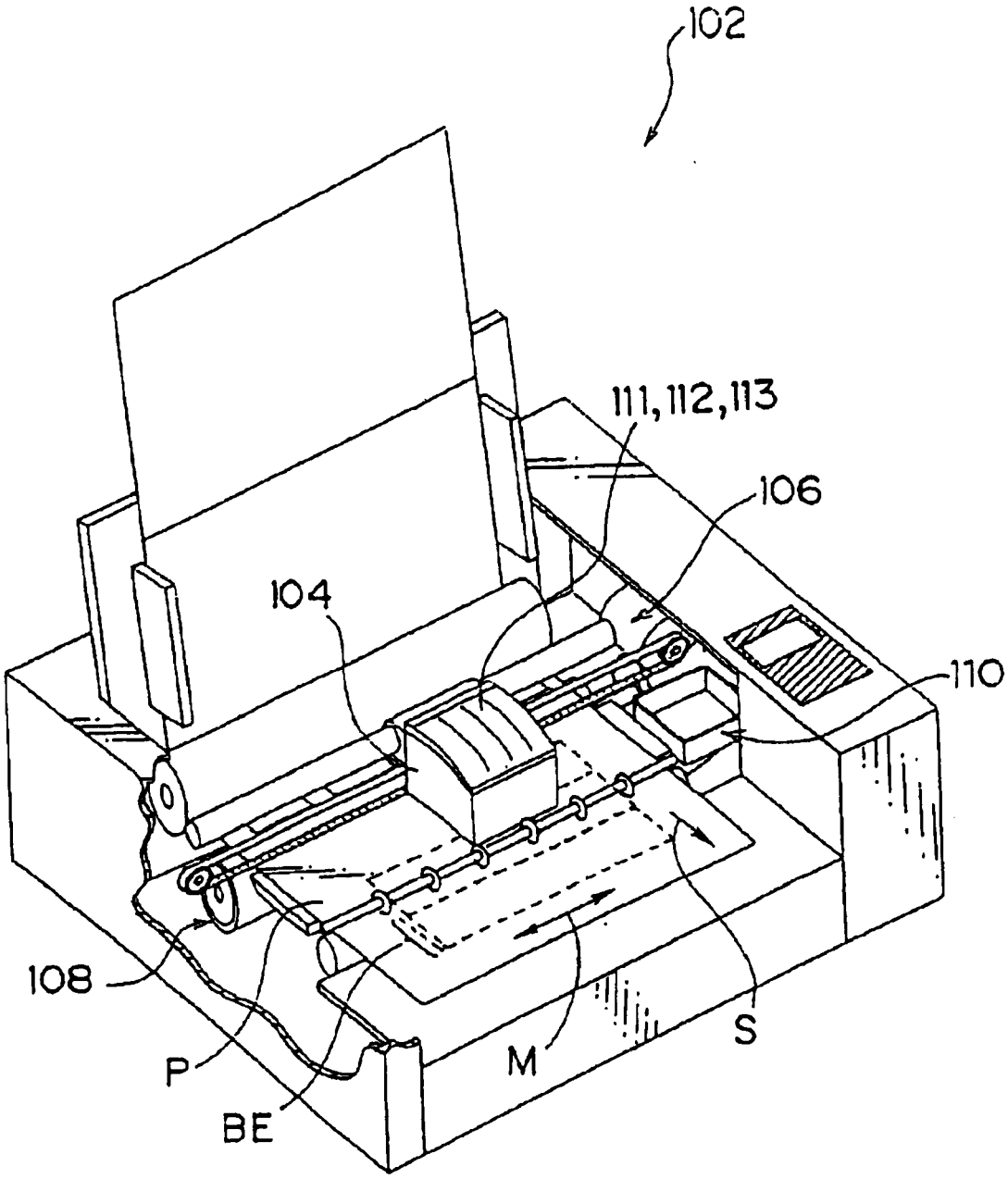
FIG. 11 is a view showing an inkjet recording device which employs an inkjet recording head relating to the first, second or third embodiment of the present invention.

Next, an inkjet recording device employing the inkjet recording head 111, 112 or 113 of the first, second or third embodiment will be described with reference to FIG. 11. FIG. 11 shows an inkjet recording device 102 which is equipped with the inkjet recording head 111, 112 or 113.

The inkjet recording device 102 is structured to include a carriage 104, a main scanning mechanism 106, a sub-scanning mechanism 108 and a maintenance station 110. The inkjet recording head 111, 112 or 113 is mounted at the carriage 104. The main scanning mechanism 106 is for scanning the carriage 104 in the main scanning direction M. The sub-scanning mechanism 108 is for scanning a recording paper P, which serves as a recording medium, in the sub-scanning direction S.

The inkjet recording head 111, 112 or 113 is mounted at the carriage 104 such that the nozzle plate 22 in which the nozzles 10 are formed (see FIGS. 1A to 2B) faces the recording paper P. By discharging ink droplets at the recording paper P while being moved in the main scanning direction M by the main scanning mechanism 106, the inkjet recording head 111, 112 or 113 implements recording of an image at a certain band region BE. When one cycle of movement in the main scanning direction M has finished, the recording paper P is conveyed in the sub-scanning direction S by the sub-scanning mechanism 108, and the next band region BE is recorded while the carriage 104 is again moved in the main scanning direction M. Image recording can be carried out over the whole of the recording paper P by repeating these operations for a number of cycles.

The inkjet recording head 111, 112 or 113 is equipped with the nozzles 10 arranged in a 5-row by 24-column matrix pattern as mentioned earlier. Therefore, an image can be formed over a broad band region BE in one cycle of movement of the carriage 104 in the main scanning direction M. That is, image recording can be carried out over the whole face of the recording paper P with just a few movement cycles of the carriage 104. Thus, printing at high speed is possible.

When the inkjet recording head 111, 112 or 113 moves in the main scanning direction M, the ink droplet discharge timings are controlled for each row of the nozzles 10. Thus, it is possible to form a straight row of dots on the recording paper P.

In the present invention, when the inkjet recording head 111, 112 or 113 is structured by a plurality of the actuator units 81, the actuator units 82 or the actuator units 85, the rows of nozzles 10 are not offset, and thus the width of the inkjet recording head 111, 112 or 113 does not increase. Hence, the inkjet recording device 102 is also not made larger. Furthermore, because there is no need to offset the ink droplet discharge timings for each of the actuator units 81, 82 or 85, output of image data is not made more complicated.

Note that the present invention is not limited to the embodiments described above.

For example, in the embodiments described above, the nozzles 10 are arranged in 5-row by 24-column matrix patterns. However, the present invention is not limited thus. For example, a single row is also possible, and two rows is also possible. Further, a number of columns other than 24 is also possible.

Figure 12:
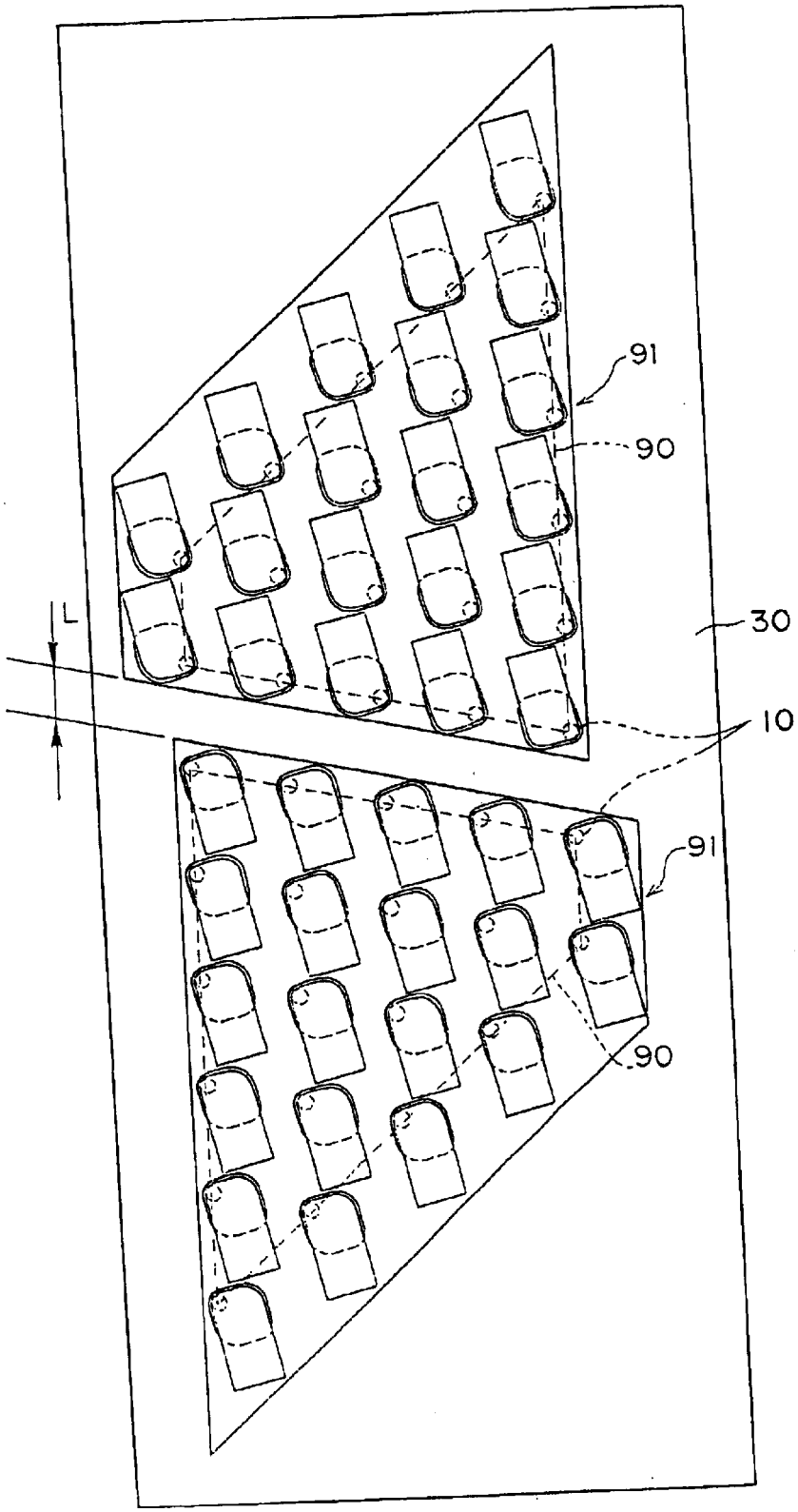
FIG. 12 is a schematic view showing an inkjet recording head relating to another embodiment of the present invention, which shows arrangements of nozzles of nozzle groups and arrangements of piezoelectric elements in actuator units being trapezoid.
Figure 13:
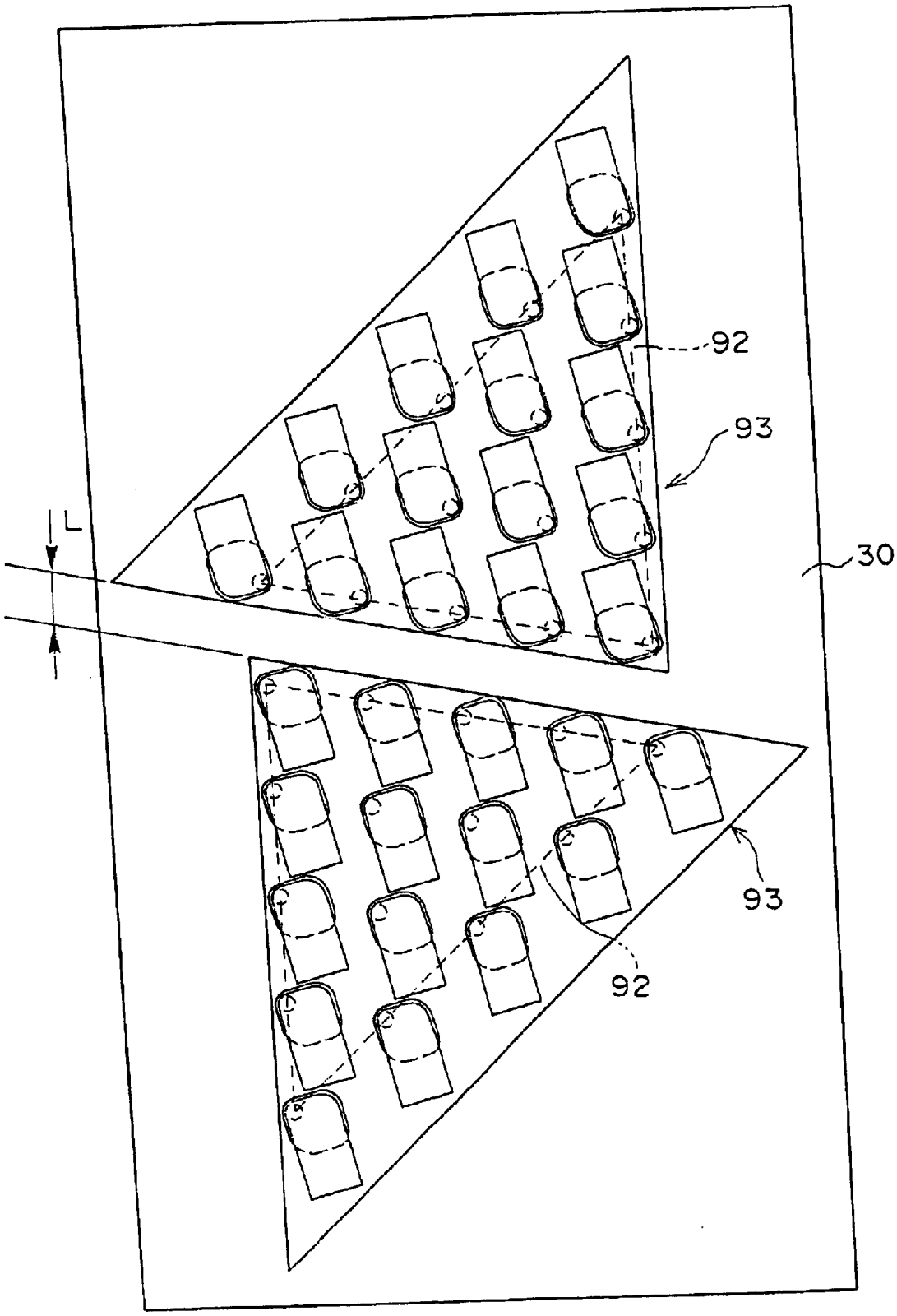
FIG. 13 is a schematic view showing an inkjet recording head relating to still another embodiment of the present invention, which shows arrangements of nozzles of nozzle groups and arrangements of piezoelectric elements in actuator units being triangular.
Figure 14:
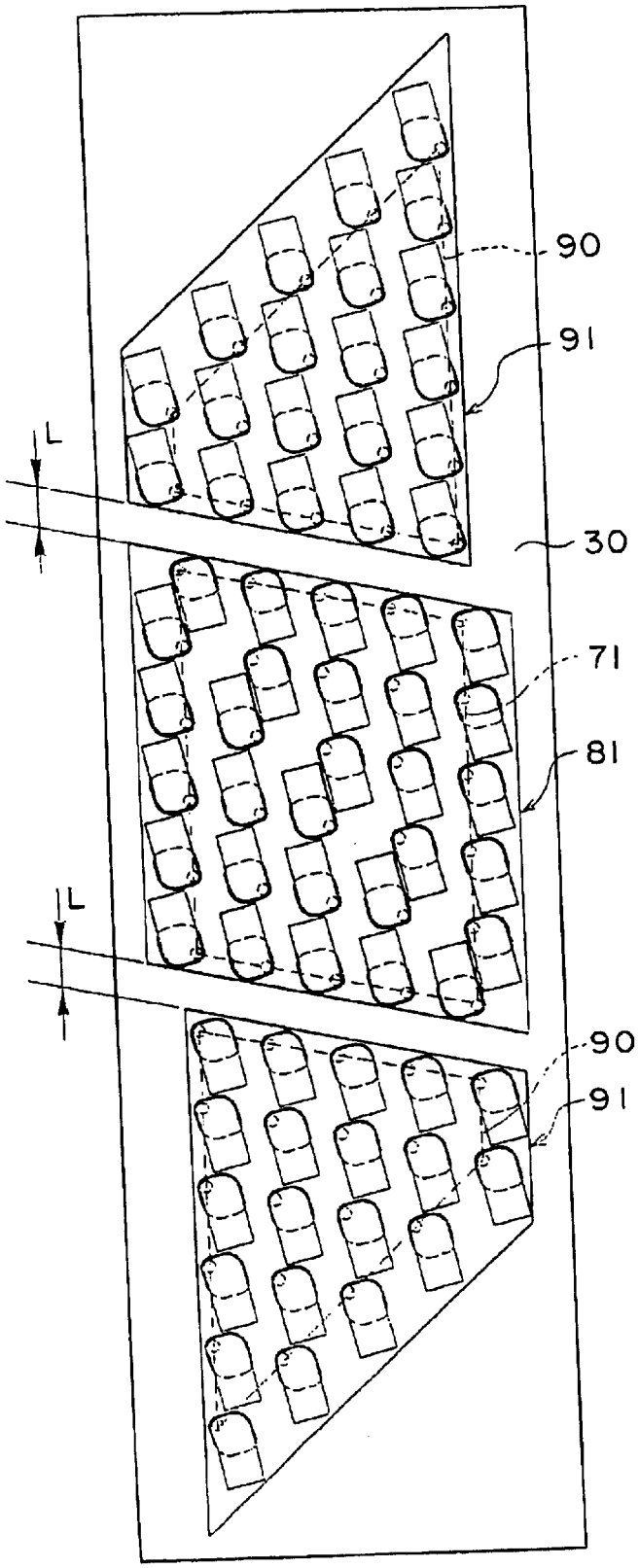
FIG. 14 is a schematic view showing an inkjet recording head relating to yet another embodiment of the present invention, which shows arrangements of nozzles of nozzle groups and arrangements of piezoelectric elements in actuator units being parallelogram-forms and trapezoids.

In the embodiments described above, shapes of the nozzle groups 70, 71 or 73 and of the actuator units 81, 82 or 85 corresponding to the nozzle groups 70, 71 or 73 have parallelogram forms. However, other arrangement forms are also possible. For example, as shown in FIG. 12, trapezoid nozzle groups 90 and actuator units 91 may be used or, as shown in FIG. 13, triangular nozzle groups 92 and actuator units 93 may be used. Moreover, these may be combined. For example, as shown in FIG. 14, a combination of trapezoid forms and parallelogram forms may be used. Further still, although the actuator units 81, 82, 85, 91 or 93 correspond to arrangement patterns of the piezoelectric elements 36 or 37 and have parallelogram forms, trapezoid forms or triangular forms, the present invention is not limited thus. Shapes of individual actuator units may be freely selected as long as the gap L is formed between neighboring actuator units.

Figure 15:
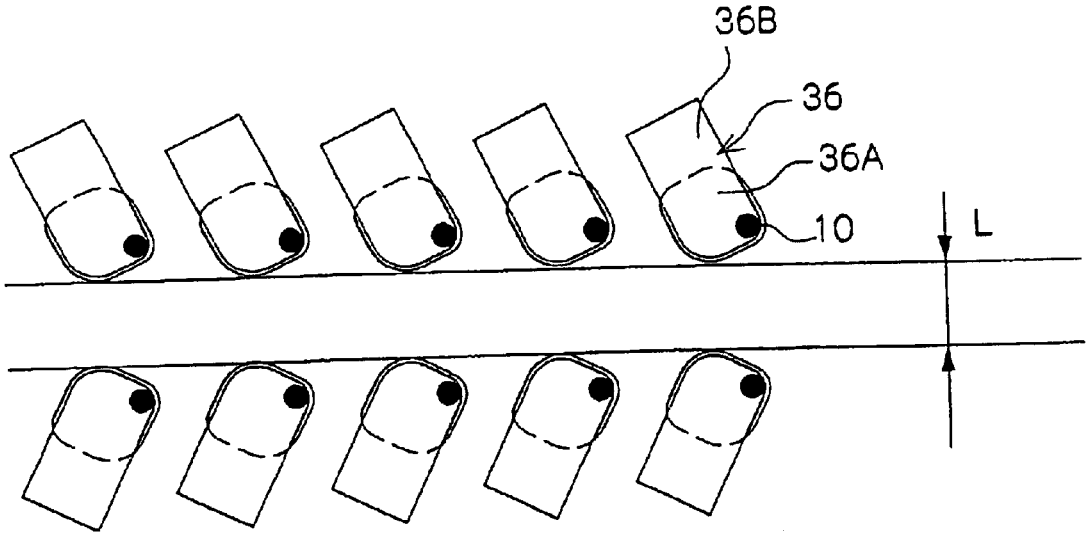
FIG. 15 is a schematic view showing how piezoelectric elements bordering a boundary of neighboring actuator units (nozzle groups) of an inkjet recording head relating to a further embodiment of the present invention are disposed in linear symmetry.
Figure 16:
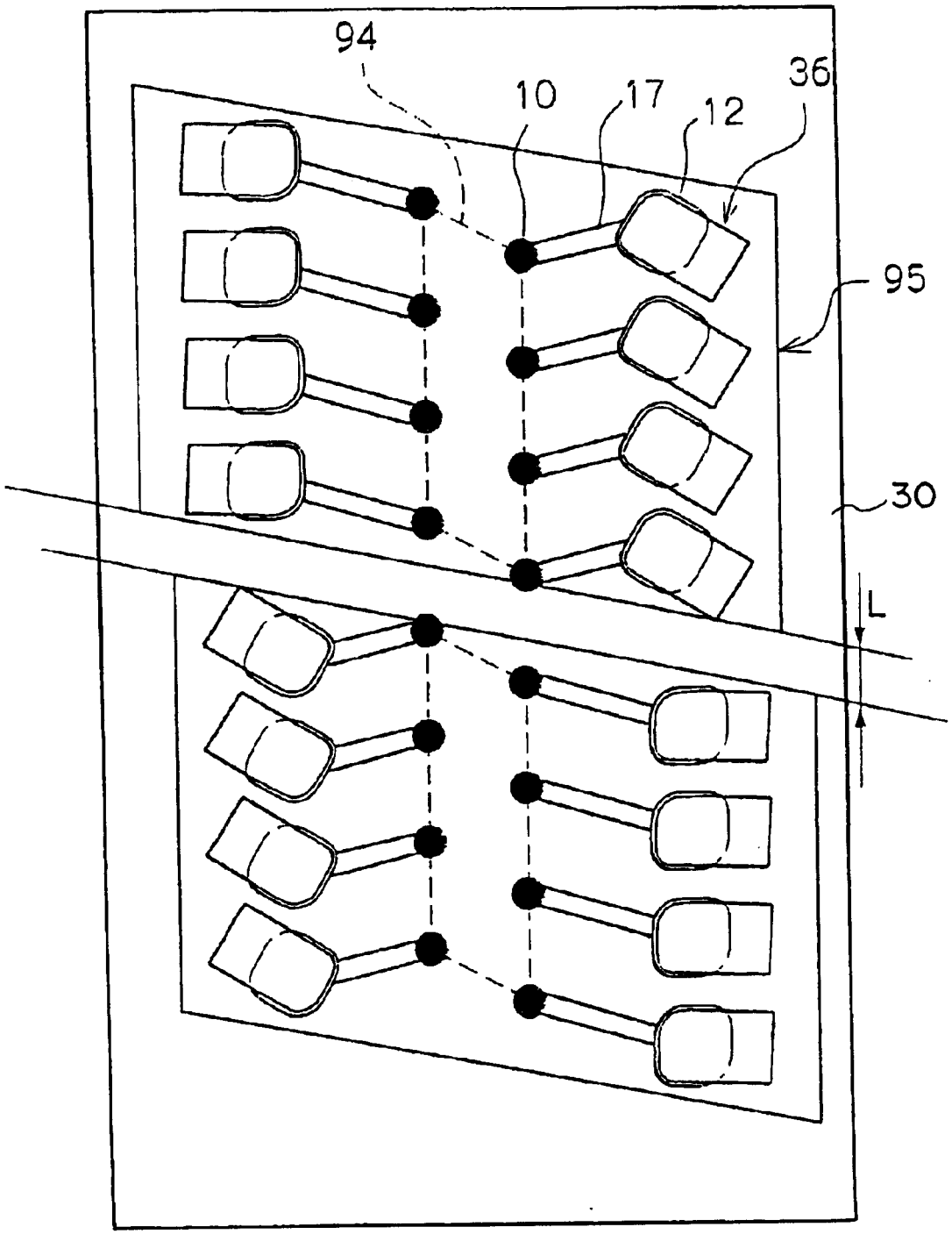
FIG. 16 is a schematic view showing an example of an arrangement in which piezoelectric elements border the boundary (precisely, relate to points on the boundary) of the neighboring actuator units (nozzle groups) of an inkjet recording head relating to a yet further embodiment of the present invention, in a manner other than line symmetry or point symmetry, with a spacing between opposing piezoelectric elements being widened.

In the embodiments described above, the piezoelectric elements 36 whose borders oppose boundaries of the neighboring nozzle groups 70, 71 or 73 have point symmetry as shown in FIG. 6. However, the present invention is not limited thus. For example, as shown in FIG. 15, the piezoelectric elements 36 whose borders oppose the boundaries between the neighboring nozzle groups 70, 71 or 73 may have line symmetry. Further, arrangements other than point symmetry or line symmetry are also possible. For example, a structure as shown in FIG. 16, in which a nozzle communication chamber 17 has a long shape in a planar direction and the nozzle 10 and pressure chamber 12 do not overlap when viewed in the ink droplet discharge direction, may be used, as long as the arrangement is such that gaps are accordingly opened up between the piezoelectric elements 36, that is, an arrangement such that a gap L is formed between actuator units 95.

In other words, arrangements such that problems do not arise in assembly, and such that gaps are formed between opposing piezoelectric elements which respectively correspond to nozzles disposed at the boundaries between nozzle groups that are adjacent in the row direction of the nozzle rows, may be used.

In the embodiments described above, the actuator units 82 and 83 are structured with the piezoelectric elements 36, the diaphragms 34 and the pressure chamber plates 32. However, the present invention is not limited thus. For example, structures in which the ink supply channel plate 30 is added to the piezoelectric elements 36, the diaphragms 34 and the pressure chamber plate 32 may be used.

As a further example, ink discharge units may be structured by flow channel units and actuator units divided up in accordance with the nozzle groups 70, 71 or 73, and these ink discharge units may be associated to constitute an inkjet recording head. With such a structure, discharge is possible at each ink discharge unit. Moreover, because gaps between opposing the piezoelectric elements 36 corresponding to the nozzles that are disposed at the boundaries between nozzle groups which are adjacent in the row direction of the nozzle rows are formed as mentioned above, the ink discharge units can be associated to constitute the inkjet recording head without offsetting the nozzle rows. Accordingly, it is possible to lengthen the inkjet recording head without increasing the width of the inkjet recording head. Furthermore, there is no need to offset the discharge timings of the ink discharge units, and the output of image data is not made complicated. Further still, if failures occur, the ink discharge units can be individually replaced.

Figure 19:
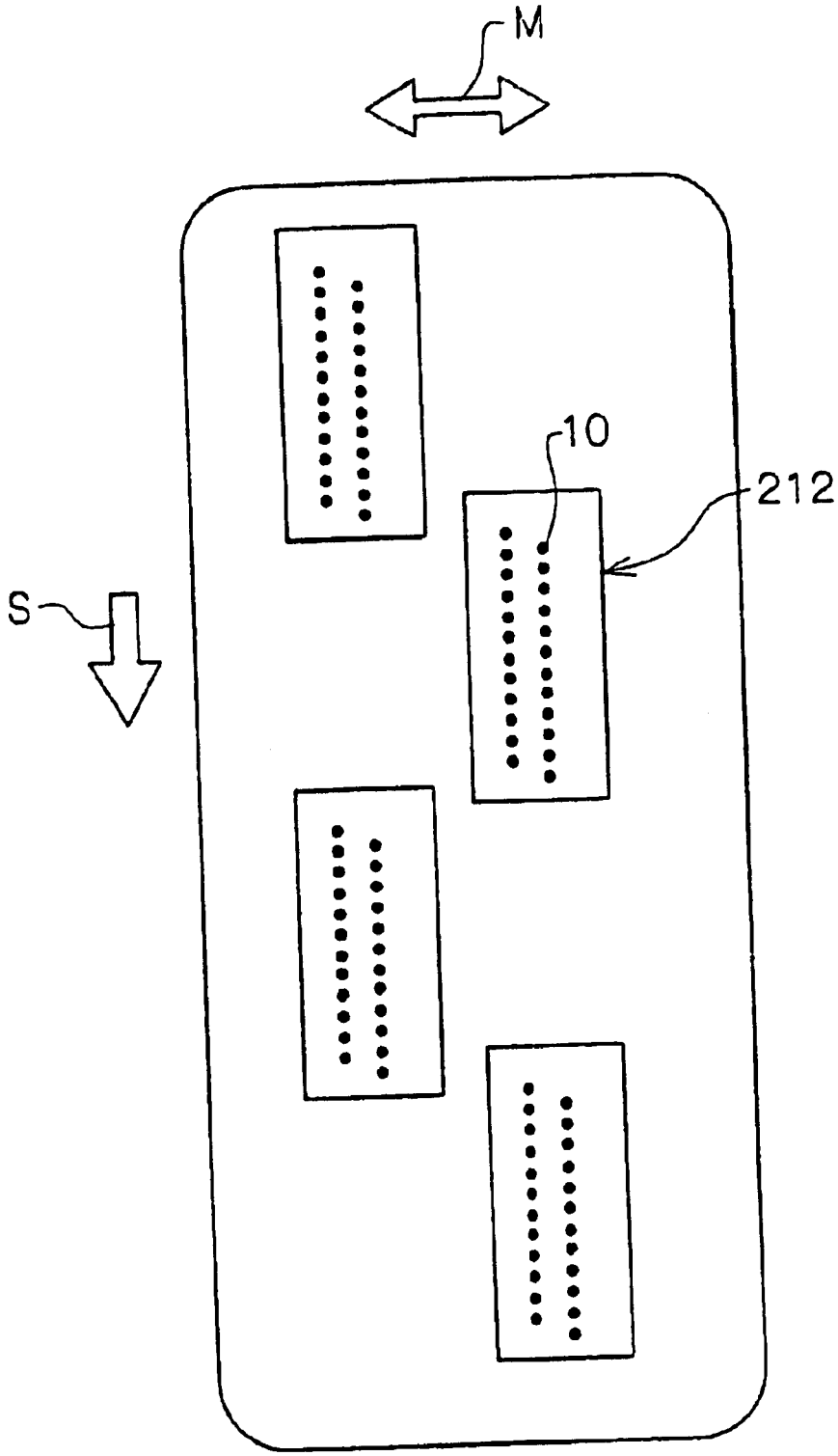
FIG. 19 is a view in which conventional inkjet recording heads are disposed in a staggered pattern.

As described above, the unit capable of discharging ink droplets of the present invention is preferably applied to an inkjet recording head. In contrast, in a case in which, as shown in FIG. 19, conventional inkjet recording heads 212 are assembled in a nozzle row direction, the inkjet recording heads 212 must be offset to left and right as viewed along the row direction of the nozzles 10, and thus the inkjet recording heads 212 are disposed in a staggered pattern so as not to overlap. Hence, it is not possible to dispose the inkjet recording heads 212 such that the nozzle rows are not offset as in the embodiments described above.

In the embodiments described above, recording is carried out while the inkjet recording head 111, 112 or 113 is conveyed by the carriage 104. However, the present invention is not limited thus. For example, an inkjet recording head at which nozzles are arranged over the whole width of the recording medium may be employed, with the inkjet recording head being fixed and recording being carried out while only the recording medium is conveyed. In such a case, the arrangement of the nozzles is rotated by 90°. That is, the direction M in FIG. 11 is the conveyance direction of the recording medium, and is also the row direction of the nozzles.

In the embodiments described above, the array of the nozzles 10 is successively displaced in the direction S, which intersects the main scanning direction M, by the spacing Y/n which is smaller than the size of the pressure chambers 12, as shown in FIGS. 3 and 4, in order to realize a pitch that is tighter than the pressure chambers 12. However, the present invention is not limited thus. The nozzles may be arrayed so as to intersect in a checkered pattern and the whole inkjet recording head may be inclined. Projecting in the main scanning direction, a high density nozzle pitch can be obtained by such inclination.

In the embodiments described above, the actuator is constituted by the piezoelectric element 36. However, the present invention is not limited thus. For example, a heat-generating resistor which pressurizes ink in the pressure chamber by heating and causing bubbling may be used, or an element which utilizes electrostatic force, magnetic force or the like may be used. Alternatively, some other form of actuator may be used.

Further, inkjet recording in the present specification is not limited to recording text and images on recording paper. That is, a recording medium is not limited to paper, and a fluid that is ejected is not limited to ink. For example, it is possible to eject ink onto a polymer film, glass or the like to prepare a color filter for a display, to eject molten solder onto a substrate to prepare solder bumps for component packages, and the like. The present invention can be utilized generally for liquid droplet ejection devices used in industry.

According to the present invention as described hereabove, an inkjet recording head can be lengthened while improving production yields and maintaining assembly characteristics without increasing width. Furthermore, output of image data is not made more complicated.

What is claimed is:

1. An inkjet recording head which scans in a direction intersecting a conveyance direction of a recording medium and records an image on the recording medium with ink drops ejected from nozzles, the inkjet recording head comprising:

a nozzle plate in which the nozzles which eject the ink drops are formed;

pressure chambers communicating with the nozzles;

actuators abutting at the pressure chambers, which at least one of increase and reduce pressures of ink in the pressure chambers; and a nozzle row parallel to the conveyance direction of the recording medium, wherein the inkjet recording head includes a plurality of nozzle groups structured by dividing up the nozzle row, and the nozzles of the nozzle row include opposing nozzles which are disposed at a boundary between neighboring nozzle groups which neighbor in the row direction of the nozzle row, the actuators include opposing actuators, which respectively correspond to the opposing nozzles, and actuators within the nozzle groups, which respectively correspond to nozzles neighboring the opposing nozzles in the row direction, and a separation between the opposing actuators disposed at the boundary is equal to or greater than separations between the opposing actuators and the actuators neighboring the opposing actuators in the row direction within the nozzle groups.

2. The inkjet recording head of claim 1, wherein arrangement forms of the nozzles of the nozzle groups comprise, when straight lines are taken between the nozzles disposed at outer edges of the nozzle groups, at least one of a triangular form, a parallelogram form and a trapezoid form.

3. The inkjet recording head of claim 2, wherein the arrangement forms of the nozzle groups comprise a combination of forms including at least one of the triangular form, the parallelogram form and the trapezoid form.

4. The inkjet recording head of claim 1, wherein a nozzle pitch of the nozzles of the nozzle groups in the row direction is the same as a spacing between the nozzles disposed at the boundary between the neighboring nozzle groups.

5. The inkjet recording head of claim 1, wherein the opposing actuators, borders of which oppose the boundary between the neighboring nozzle groups, comprise point symmetry.

6. The inkjet recording head of claim 1, wherein the opposing actuators, borders of which oppose the boundary between the neighboring nozzle groups, comprise line symmetry.

7. The inkjet recording head of claim 1, further comprising an actuator unit for each nozzle group, the actuator unit being structured to include at least the pressure chambers and the actuators respectively corresponding to the nozzles constituting the nozzle groups.

8. The inkjet recording head of claim 7, wherein each nozzle group is provided with an ink discharge unit including at least the nozzle plate and the actuator unit.

9. The inkjet recording head of claim 1, wherein the actuators of each nozzle group are disposed with an orientation the same as the actuators disposed at the boundary of the nozzle group.

10. The inkjet recording head of claim 1, wherein positions of the actuators within each nozzle group comprise point symmetry, with a center of the nozzle group as the point of symmetry thereof.

11. The inkjet recording head of claim 1, wherein the actuators comprise piezoelectric elements for converting electrical energy to mechanical energy.

12. The inkjet recording head of claim 1, wherein the actuators comprise heat-generating resistors which pressurize the ink in the pressure chambers by heating and causing bubbling.

13. The inkjet recording head of claim 1, wherein an n-th row of one of the nozzle groups, n being an arbitrary integer of at least 1, is aligned with the n-th row of another of the nozzle groups rather than being offset, the other nozzle group neighboring the one nozzle group in the row direction.

14. An inkjet recording device employing the inkjet recording head of claim 1.

15. An inkjet recording head which records an image with ink drops ejected from nozzles over a width of a recording medium which is being conveyed, the inkjet recording head comprising:

a nozzle plate in which the nozzles which eject the ink drops are formed;

pressure chambers communicating with the nozzles;

actuators abutting at the pressure chambers, which at least one of increase and reduce pressures of ink in the pressure chambers; and a nozzle row in a direction intersecting the conveyance direction of the recording medium, wherein the inkjet recording head includes a plurality of nozzle groups structured by dividing up the nozzle row, and the nozzles of the nozzle row include opposing nozzles which are disposed at a boundary between neighboring nozzle groups which neighbor in the row direction of the nozzle row, the actuators include opposing actuators, which respectively correspond to the opposing nozzles, and actuators within the nozzle groups, which respectively correspond to nozzles neighboring the opposing nozzles in the row direction, and a separation between the opposing actuators disposed at the boundary is equal to or greater than separations between the opposing actuators and the actuators neighboring the opposing actuators in the row direction within the nozzle groups.

16. An inkjet recording head which scans in a direction intersecting a conveyance direction of a recording medium and records an image on the recording medium with ink drops ejected from nozzles, the inkjet recording head comprising:

a nozzle plate in which the nozzles which eject the ink drops are formed;

pressure chambers communicating with the nozzles;

actuators abutting at the pressure chambers, which at least one of increase and reduce pressures of ink in the pressure chambers; and a nozzle row parallel to the conveyance direction of the recording medium, wherein the inkjet recording head includes a plurality of nozzle groups structured by dividing up the nozzle row, and positions of the actuators within the nozzle groups include point symmetry, with a center of the nozzle group as the point of symmetry thereof.

17. The inkjet recording head of claim 16, wherein an n-th row of one of the nozzle groups, n being an arbitrary integer of at least 1, is aligned with the n-th row of another of the nozzle groups rather than being offset, the other nozzle group neighboring the one nozzle group in the direction of the row.

18. An inkjet recording device employing the inkjet recording head of claim 16.

19. An inkjet recording head which records an image with ink drops ejected from nozzles over a width of a recording medium which is being conveyed, the inkjet recording head comprising:

a nozzle plate in which the nozzles which eject the ink drops are formed;

pressure chambers communicating with the nozzles;

actuators abutting at the pressure chambers, which at least one of increase and reduce pressures of ink in the pressure chambers; and a nozzle row in a direction intersecting the conveyance direction of the recording medium, wherein the inkjet recording head includes a plurality of nozzle groups structured by dividing up the nozzle row, and positions of the actuators within the nozzle groups include point symmetry, with a center of the nozzle group as the point of symmetry thereof.

20. The inkjet recording head of claim 19, wherein an n-th row of one of the nozzle groups, n being an arbitrary integer of at least 1, is aligned with the n-th row of another of the nozzle groups rather than being offset, the other nozzle group neighboring the one nozzle group in the row direction.

* * * * *